United States Patent [19]

Eda et al.

[11] Patent Number: 4,551,268

[45] Date of Patent: Nov. 5, 1985

[54] VOLTAGE-DEPENDENT RESISTOR AND METHOD OF MAKING THE SAME

[75] Inventors: Kazuo Eda, Hirakata; Yasuharu Kikuchi, Moriguchi; Osamu Makino, Katano; Michio Matsuoka, Ibaraki, all of Japan

[73] Assignee: Matsushita Electric Industrial Co., Ltd., Osaka, Japan

[21] Appl. No.: 465,678

[22] Filed: Feb. 10, 1983

Related U.S. Application Data

[62] Division of Ser. No. 210,394, Nov. 25, 1980, Pat. No. 4,386,021.

[30] Foreign Application Priority Data

Nov. 27, 1979 [JP] Japan ..... 54-154085
Nov. 27, 1979 [JP] Japan ..... 54-154086
Nov. 27, 1979 [JP] Japan ..... 54-154087

[51] Int. Cl.[4] ..... H01B 1/06

[52] U.S. Cl. ..... 252/519; 252/518; 338/20; 338/21; 338/313

[58] Field of Search ..... 252/518, 519, 520; 338/20, 21, 307, 313; 29/610 R, 621; 264/61; 75/213, 214, 221

[56] References Cited

U.S. PATENT DOCUMENTS

| | | | |
|---|---|---|---|
| 3,950,274 | 4/1976 | May | 252/519 |
| 4,045,374 | 8/1977 | Nagasawa et al. | 252/518 |
| 4,111,851 | 9/1978 | Ho et al. | 252/518 |
| 4,147,670 | 4/1979 | Shohata et al. | 252/519 |
| 4,169,071 | 9/1979 | Eda et al. | 252/517 |
| 4,180,483 | 12/1979 | Ho et al. | 252/518 |
| 4,452,729 | 6/1984 | Carlson et al. | 252/518 |

OTHER PUBLICATIONS

Okamoto M. et al.; Jpn. Kokai, 79, 108, 295, cited as Chemical Abstracts, 91, 203137b (1979).

*Primary Examiner*—Josephine L. Barr
*Attorney, Agent, or Firm*—Wenderoth, Lind & Ponack

[57] ABSTRACT

The present invention provides a voltage-dependent resistor of the bulk-type in which zinc oxide (ZnO) powder and additives are admixed to form a sintered body composition having as the main constituent, zinc oxide, and in which the mixture is formed into a resistor body, the body is sintered, and electrodes are applied to the opposite surfaces of the sintered body, the improvement comprising the step of, prior to sintering and admixture with said zinc oxide, admixing all amount of boron oxide ($B_2O_3$) with other additives in the form of a borosilicate glass, which is composed of 5 to 30 weight percent of boron oxide ($B_2O_3$) and 70 to 95 weight percent of silicon oxide ($SiO_2$). A process for the production of said resistor is also provided.

2 Claims, 1 Drawing Figure

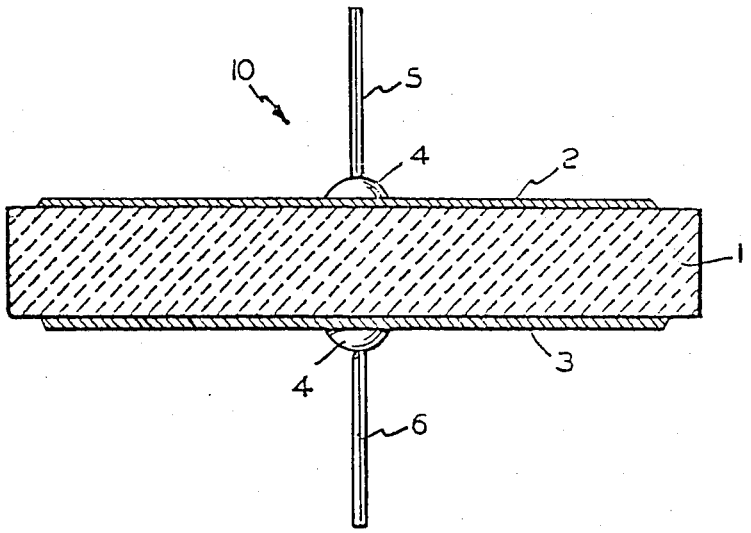
10
5
4
2
1
3
4
6

VOLTAGE-DEPENDENT RESISTOR AND METHOD OF MAKING THE SAME

This is a Rule 60 divisional of Ser. No. 210,394, filed Nov. 25, 1980, now U.S. Pat. No. 4,368,021.

This invention relates to a voltage-dependent resistor (varistor) having non-ohmic properties (voltage-dependent property) due to the bulk thereof and a process for making it. This invention relates more particularly to a voltage-dependent resistor, which is suitable for a lightning arrester and a surge absorber.

Various voltage-dependent resistors have been widely used for suppression of abnormally high surges induced in electrical circuits. The electrical characteristics of such voltage-dependent resistors are expressed by the relation:

$$I=(V/C)^n \quad (1)$$

where V is the voltage across the resistor, I is the current flowing through the resistor, C is a constant corresponding to the voltage at a given current and exponent n is a numerical value greater than 1. The value of n is calculated by the following equation:

$$n = \frac{\log_{10}(I_2/I_1)}{\log_{10}(V_2/V_1)} \quad (2)$$

where $V_1$ and $V_2$ are the voltage at given currents $I_1$ and $I_2$, respectively. Usually $I_1$ is 0.1 mA and $I_2$ is 1 mA. The desired volue of C depends upon the kind of application to which the resistor is to be put. Usually C value is expressed by the voltage at 1 mA per mm. It is ordinarily desirable that the value of C is between several scores of volts and several hundreds volts. The value of n is desired to be as large as possible because this exponent determines the extent to which the resistors depart from ohmic characteristics. Conveniently, n-value defined by $I_1$, $I_2$, $V_1$ and $V_2$ as shown in equation (2) is expressed by $_1n_2$ for distinguishing from n-value calculated by other currents or voltages. For application to a surge absorber and a lightning arrester, it is desirable that the residual (clamp) voltage ratio (which is expressed by the ratio of the voltage at xA ($V_{xA}$) and the voltage at 1 mA ($V_{1\,mA}$); $V_{xA}/V_{1\,mA}$) be small since this ratio determines the ability to protect the equipment and components in electrical circuits against surges. Usually x is 100, so the residual voltage ratio is evaluated by $V_{100\,A}/V_{1\,mA}$. It is also desirable that the change rate of C-value after impulse application be as close to zero as possible. This characteristic is called surge withstand capability and is usually expressed by the change rate of C value after two applications of impulse current of 1000 A whose wave form is 8×20 μs.

As voltage-dependent resistors for a lightning arrester, silicon carbide varistors and zinc oxide voltage-dependent resistors are known. The silicon carbide varistors have nonlinearity due to the contacts among the individual grains of silicon carbide bonded together by a ceramic binding material, i.e. to the bulk, and the C-value is controlled by changing a dimension in the direction in which the current flows through the varistors. In addition, the silicon carbide varistors have good surge withstand capability thus rendering them suitable e.g. as surge absorbers and as characteristic elements of lightning arresters. The characteristic elements are used usually by connecting them in series with discharging gaps and determine the level of the discharging voltage and the follow current.

However, the silicon carbide varistors have a relatively low n-value ranging from 3 to 7 which results in a poor suppression of lightning surge or increase in the follow current. Another defect of the arrester with a discharging gap is slow response to surge voltage and a very short rise time such as below 1 μs. It is desirable for the arrester to suppress the lightning surge and the follow current to a level as low as possible and respond to surge voltage instantaneously. The silicon carbide varistors, however, have a relatively low n-value ranging from 3 to 7 which results in poor surge suppression.

There have been known, on the other hand, voltage-dependent resistors of the bulk type comprising a sintered body of zinc oxide with additives, as seen in U.S. Pat. Nos. 3,633,458, 3,632,529, 3,634,337, 3,598,763, 3,682,841, 3,642,664, 3,648,725, 3,687,871, 3,723,175, 3,778,743, 3,806,765, 3,811,103, 3,936,396, 3,863,193, 3,872,582 and 3,953,373. These zinc oxide voltage-dependent resistors of the bulk type contain, as additives, one or more combinations of oxides of fluorides of bismuth, cobalt, manganese, barium, boron, berylium, magnesium, calcium, strontium, titanium, antimony, germanium, chromium and nickel, and the C-value is controllable by changing, mainly, the compositions of said sintered body and the distance between electrodes and they have excellent voltage-dependent properties in n-value.

Conventional zinc oxide voltage-dependent resistors have such a large n-value that they were expected to be used without series discharging gaps as characteristic elements in lightning arresters. However, zinc oxide voltage-dependent resistors still have a big problem to be solved in order to be applied to lightning arresters without series discharging gaps. The problem is the thermal run away life under continuous voltage stress, especially with application of surges. This is one of the most important problems to be solved in practice. When a zinc oxide voltage-dependent resistor is applied to the lightning arrester without a series discharging gap, the voltage of the circuit or the distribution line is designed to be in the range from 50 to 80 percent of the varistor voltage (the voltage between electrodes at 1 mA) of the zinc oxide voltage-dependent resistor. Accordingly, the total varistor voltage of zinc oxide voltage-dependent resistors which is connected in series is designed to be in the range from 120 kV to 75 kV for the application to the lightning arrestor in a 60 kV electric power transmission line.

In Japan, they usually have 10 to 30 thunderstorm days a year, though it depends on the district. On those days, the lightning arresters are subjected to lightning surges. If the number of lightning surges are assumed to be about 10 per thunderstorm day, the lightning arresters must be subjected to 100 to 300 lightning surges a year. The lightning arresters are usually used for more than 20 years, so that they must withstand at least 2000 to 6000 lightning surges with the voltage stress of 60 kV for 20 years. The average impulse current flowing through the zinc oxide voltage-dependent resistors in the lightning arresters is about 100 A (in the waveform of 8×20 μs). Accordingly, the zinc oxide voltage-dependent resistor in the lightning arresters without series discharging gaps must have thermal run away life of more than 20 years under the continuous voltage stress of 60 kV with 2000 to 6000 lightning surges of 100 A of the waveform of $8\times20$ μs.

Conventional zinc oxide voltage-dependent resistors show fairly good surge withstand capability and stability for the change of environment in a separate condition. That is, they show a fairly good surge withstand capability without continuous voltage stress at the same time or they show a fairly good stability against voltage stress for a long term without the shooting of impulse currents at the same time. However, the conventional zinc oxide voltage-dependent resistors do not show a sufficient thermal run away life over a long term under a condition where they have both a voltage stress of 80 to 50 percent of the varistor voltage and 2000 to 6000 surges of impulse currents of 100 A at the same time. The development of the voltage-dependent resistors having an enough thermal run away life under continuous voltage stress with surges has been required for the application to lightning arresters without series discharging gaps.

An object of the present invention is to provide a voltage-dependent resistor, and a method for making it, having a high n-value, a low residual voltage ratio, a good surge withstand capability and a long thermal run away life under continuous voltage stress with surges. The characteristics of high n-value, low residual voltage ratio and good surge withstand capability is indispensable for the application of lightning arresters. The last one, the long thermal run away life under continuous voltage stress with surges, is one of the most important characteristics which should be improved for that application.

This and other objects and features of this invention will become apparent upon consideration of the following detailed description taken together with the accompanying drawing is which the single FIGURE in a cross-sectional view of a voltage-dependent resistor in accordance with this invention.

Before proceeding with a detailed description of the manufacturing process of the voltage-dependent resistor contemplated by this invention, its construction will be described with reference to the single FIGURE, wherein reference numeral 10 designates, as whole, a voltage-dependent resistor comprising, as its active element, a sintered body having a pair of electrodes 2 and 3 in an ohmic contact with two opposite surfaces thereof. The sintered body 1 is prepared in a manner hereinafter set forth and is in any form such as circular, square of rectangular plate form. This invention also provides a process for making a bulk-type voltage-dependent resistor comprising a sintered body consisting essentially of, as a major part, zinc oxide (ZnO), and additives, and having electrodes to the opposite surfaces of said sintered body, characterized by a high n-value, a low residual voltage ratio, a good surge withstand capability and especially a long thermal run away life under continuous voltage stress with surges.

It has been discovered according to the invention that a voltage-dependent resistor comprising a sintered body of a composition which comprises, as additives, 0.1 to 3.0 mole percent of bismuth oxide ($Bi_2O_3$), 0.1 to 3 mole percent of cobalt oxide ($Co_2O_3$), 0.1 to 3 mole percent of manganese oxide ($MnO_2$), 0.1 to 3.0 mole percent of antimony oxide ($Sb_2O_3$), 0.05 to 1.5 mole percent of chromium oxide ($Cr_2O_3$), at least one member selected from the group consisting of 0.1 to 10 mole percent of silicon oxide ($SiO_2$) and 0.1 to 3 mole percent of nickel oxide (NiO), at least one member selected from the group consisting of 0.0005 to 0.025 mole percent of aluminum oxide ($Al_2O_3$) and 0.005 to 0.025 mole percent of gallium oxide ($Ga_2O_3$), and 0.005 to 0.3 mole percent of boron oxide ($B_2O_3$), and if necessary, 0.00005 to 0.3 mole percent of silver oxide ($Ag_2O$), and the remainder being zinc oxide (ZnO) as a main constituent, with electrodes applied to opposite surfaces of the sintered body, has a non-ohmic property (voltage-dependent property) due to the bulk itself. Therefore, its C-value can be changed without impairing its n-value by changing the distance between the electrodes at opposite surfaces.

According to this invention, a voltage-dependent resistor has a high n-value, a small residual voltage ratio, a good surge withstand capability and a long thermal run away life under continuous voltage stress with surges. According to this invention, the n-value and the thermal run away life under continuous voltage stress with surges are improved by adding as additives the entire amount of boron oxide and silver oxide and a part of the cobalt oxide and silicon oxide in glass frit form.

EXAMPLE 1-1

Zinc oxide and additives as shown in Tables 1 and 2 were mixed in a wet will for 24 hours. Each of the mixtures was dried and pressed in a mold disc of 17.5 mm in diameter and 2 mm in thickness at a pressure of 250 kg/cm$^2$. The pressed bodies were sintered in air at 1230° C. for 2 hours, and then furnace-cooled to room temperature. Each sintered body was lapped at the opposite surfaces thereof into the thickness of 1.5 mm by silicon carbide abrasive in particle size of 30 μm in mean diameter. The opposite surfaces of the sintered body were provided with spray metallized films of aluminum by a per se well known technique.

The electrical characteristics of the resultant sintered bodies are shown in Tables 1 and 2, which show that C-values of unit thickness (1 mm), n-values defined between 0.1 mA and 1 mA according to the equation (2), residual voltage ratios of $V_{100\,A}$ to $V_{1\,mA}$, change rates of C-values after the impulse test and thermal run away lives under continuous voltage stress with surges.

The voltage at 100 A ($V_{100\,A}$) is measured by using a waveform expressed by $8\times20$ μs. The change rate against surge is evaluated measuring the change rate of C-value of the voltage-dependent resistor after applying 2 impulse currents of 1000 A whose waveform is expressed by $8\times20$ μs. The thermal run away life was evaluated by the time until a thermal run away occurs under conditions such that both the AC voltage (60 Hz) whose amplitude is 80 percent of C-value and the impulse current of 100 A, $8\times20$ μs are applied at the same time at a constant temperature of 100° C.

Tables 3 and 4 show that an n-value above 40, a residual voltage ratio velow 1.60, a surge withstand capability below −5.0 percent, a thermal run away life under voltage stress with surges more than 50 hours can be obtained when said sintered body comprises, as a main constituent, zinc oxide (ZnO), and as additives, 0.1 to 3.0 mole percent of bismuth oxide ($Bi_2O_3$), 0.1 to 3.0 mole percent of cobalt oxide ($Co_2O_3$), 0.1 to 3.0 mole percent of manganese oxide ($MnO_2$), 0.1 to 3.0 mole percent of antimony oxide ($Sb_2O_3$), 0.05 to 1.5 mole percent of chromium oxide ($Cr_2O_3$), 0.005 to 0.3 mole percent of boron oxide ($B_2O_3$), and at least one member selected from the group of 0.0005 to 0.025 mole percent of aluminum oxide ($Al_2O_3$) and 0.0005 to 0.025 mole percent of gallium oxide ($Ga_2O_3$), and 0.1 to 10.0 mole percent of silicon oxide ($SiO_2$).

EXAMPLE 1-2

Zinc oxide and additives of No. a-1 or No. b-1 in Table 1 and 2 and glass frits whose composition is shown in Table 3 were fabricated into voltage dependent resistors by the same process as that of Example 1-1. The electrical properties of the resultant resistors are shown in Table 4 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 4 shows an improvement of n-value of the more than 10 and an improvement in the thermal run away life of more than 20 hours.

Table 4 shows that the n-value is improved from above 40 to above 50 and the thermal run away life under voltage stress with surges is improved from more than 50 to more than 70 by adding as an additive, the entire amount of boron oxide ($B_2O_3$) in the form of borosilicate glass.

EXAMPLE 1-3

Zinc oxide and additives of No. a-1 or No. b-1 in Table 1 and 2 and glass frits whose composition is shown in Table 5 were fabricated into voltage dependent resistors by the same process as that of Example 1-1. The electrical properties of the resultant resistors are shown in Table 6 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 6 shows an improvement of the n-value of more than 20 and an improvement in the thermal run away life of more than 30 hours.

Table 6 shows that the thermal run away life under voltage stress with surges is improved from more than 50 to more than 80 by adding as additives, the entire amount of boron oxide ($B_2O_3$) and a part of bismuth oxide ($Bi_2O_3$) in the form of borosilicate bismuth glass.

EXAMPLE 1-4

Zinc oxide and additives of No. a-1 or No. b-1 in Table 1 and 2 and glass frits whose composition is shown in Table 7 were fabricated into voltage deendent resistors by the same process as that of Example 1-1. The electrical properties of the resultant resistors are shown in Table 8 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 8 shows an improvement of the n-value of more than 20 and an improvement in the thermal run away life of more than 30 hours.

Table 8 shows that the n-value is improved from above 40 to above 60 and the thermal run away life under voltage stress with surges is improved from more than 50 to more than 80 by adding as additives, the entire amount of boron oxide ($B_2O_3$), a part of bismuth oxide ($Bi_2O_3$) and a part of cobalt oxide ($Co_2O_3$) in the form of borosilicate bismuth glass with cobalt oxide.

EXAMPLE 2-1

Zinc oxide and additives of Table 9 and 10 were fabricated into voltage-dependent resistors by the same process as that of Example 1-1. The electrical properties of the resultant resistors are shown in Tables 9 and 10 in which the C-values of unit thickness (1 mm), the n-values defined between 0.1 mA and 1 mA, and the residual voltage ratios $V_{100\,A}$ to $V_{1\,mA}$, the change rates of C-value after impulse test and the thermal run away lives under continuous voltage stress with surges are shown.

Tables 9 and 10 show that an n-value above 50, a residual voltage ratio below 1.60, a surge withstand capability below −5.0 percent, a thermal run away life under voltage stress with surges of more than 100 hours can be obtained when said sintered body comprises, as a main constituent, zinc oxide (ZnO), and as additives, 0.1 to 3.0 mole percent of bismuth oxide ($Bi_2O_3$), 0.1 to 3.0 mole percent of cobalt oxide ($Co_2O_3$), 0.1 to 3.0 mole percent of manganese oxide ($MnO_2$), 0.1 to 3.0 mole percent of antimony oxide ($Sb_2O_3$), 0.05 to 1.5 mole percent of chromium oxide ($Cr_2O_3$), 0.005 to 0.3 mole percent of boron oxide ($B_2O_3$), and at least one member selected from the group of 0.0005 to 0.025 mole percent of aluminum oxide ($Al_2O_3$) and 0.0005 to 0.025 mole percent of gallium oxide ($Ga_2O_3$), 0.1 to 10.0 mole percent of silicon oxide ($SiO_2$) and 0.0005 to 0.3 mole percent of silver oxide ($Ag_2O$).

EXAMPLE 2-2

Zinc oxide and additives of No. a-1 or No. b-1 in Table 1 and 2 and glass frits whose composition is shown in Table 11 were fabricted into voltage dependent resistors by the same process as that of Example 1-1. The electrical properties of the resultant resistors are shown in Table 12 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 12 shows an improvement of n-value of the more than 10 and an improvement in the thermal run away life of more than 20 hours.

Table 12 shows that the n-value is improved from above 50 to above 60 and the thermal run away life under voltage stress with surges is improved from more than 100 to more than 120 by adding the additives of all amount of boron oxide ($B_2O_3$) and all amount of silver oxide ($Ag_2O$), in the form of borosilicate glass with silver oxide.

EXAMPLE 2-3

Zinc oxide and additives of No. a-1 or No. b-1 in Table 1 and 2 and glass frits whose composition is shown in Table 13 were fabricated into voltage dependent resistors by the same process as that of Example 1-1. The electrical properties of the resultant resistors are shown in Table 14 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 14 shows an improvement of the n-value of more than 10 and an improvement in the thermal run away life of more than 30 hours.

Table 14 shows that the n-value is improved from above 50 to above 60 and the thermal run away life under voltage stress with surges is improved from more than 100 to more than 130 by adding as additives the entire amount of boron oxide ($B_2O_3$), the entire amount of silver oxide ($Ag_2O$) and a part of bismuth oxide ($Bi_2O_3$) in the form of borosilicate bismuth glass.

EXAMPLE 2-4

Zinc oxide and additives of No. a-1 or No. b-1 in Table 1 and 2 and glass frits whose composition is shown in Table 15 were fabricated into voltage dependent resistors by the same process as that of Example 1-1. The electrical properties of the resultant resistors are shown in Table 16 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 16 shows an improvement of the n-value of more than 20 and an improvement in the thermal run away life of more than 30 hours.

Table 16 shows that the n-value is improved from above 50 to above 70 and the thermal run away life under voltage stress with surges is improved from more than 100 to more than 130 by adding as additives the entire amount of boron oxide ($B_2O_3$), the entire amount of silver oxide ($Ag_2O$), a part of the bismuth oxide ($Bi_2O_3$) and a part of the cobalt oxide ($Co_2O_3$) in the form of borosilicate bismuth glass with silver oxide and cobalt oxide.

EXAMPLE 3-1

Zinc oxide and additives of Table 17 and 18 were fabricated into voltage-dependent resistors by the same process as that of Example 1-1. The electrical properties of the resultant resistors are shown in Tables 17 and 18 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges are shown.

Tables 17 and 18 show that an n-value above 30, a residual voltage ratio below 1.70, a surge withstand capability below −4.0 percent, a thermal run away life under voltage stress with surges, of more than 50 hours can be obtained when said sintered body comprises, as a main constituent, zinc oxide (ZnO), and as additives, 0.1 to 3.0 mole percent of bismuth oxide ($Bi_2O_3$), 0.1 to 3.0 mole percent of cobalt oxide ($Co_2O_3$), 0.1 to 3.0 mole percent of manganese oxide ($MnO_2$), 0.1 to 3.0 mole percent of antimony oxide ($Sb_2O_3$), 0.05 to 1.5 mole percent of chromium oxide ($Cr_2O_3$), 0.005 to 0.3 mole percent of boron oxide ($B_2O_3$), and at least one member selected from the group of 0.0005 to 0.025 mole percent of aluminum oxide ($Al_2O_3$) and 0.0005 to 0.025 mole percent of gallium oxide ($Ga_2O_3$), and 0.1 to 3.0 mole percent of nickel oxide (NiO).

EXAMPLE 3-2

Zinc oxide and additives of No. a-1 or No. b-1 in Table 17 and 18 and glass frits whose composition is shown in Table 3 were fabricated into voltage dependent resistors by the same process as that of Example 1-1. The electrical properties of the resultant resistors are shown in Table 19 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 19 shows an improvement of the n-value of more than 10 and an improvement in the thermal run away life of more than 20 hours.

Table 19 shows that the n-value is improved from above 30 to above 40 and the thermal run away life under voltage stress with surges is improved from more than 50 to more than 70 by adding as additives, the entire amount of boron oxide ($B_2O_3$), in the form of borosilicate glass.

EXAMPLE 3-3

Zinc oxide and additives of No. a-1 or No. b-1 in Table 17 and 18 and glass frits whose composition is shown in Table 5 were fabricated into voltage dependent resistors by the same process as that of Example 1-1. The electrical properties of the resultant resistors are shown in Table 20 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 20 shows an improvement of the n-value of more than 10 and an improvement in the thermal run away life of more than 30 hours.

Table 20 shows that the n-value is improved from above 30 to above 40 and the thermal run away life under voltage stress with surges is improved from more than 50 to more than 80 by adding as additives, the entire amount of boron oxide ($B_2O_3$), and a part of the bismuth oxide ($Bi_2O_3$) in the form of borosilicate bismuth glass.

EXAMPLE 3-4

Zinc oxide and additives of No. a-1 or No. b-1 in Table 17 and 18 and glass frits whose composition is shown in Table 9 were fabricated into voltage dependent resistors by the same process as that of Example 1-1. The electrical properties of the resultant resistors are shown in Table 21 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 21 shows an improvement of the n-value more than 20 and the improvement in the thermal run away life of more than 30 hours.

Table 21 shows that the n-value is improved from above 30 to above 50 and the thermal run away life under voltage stress with surges is improved from more than 50 to more than 80 hours by adding as additives, the entire amount of boron oxide ($B_2O_3$), the entire amount of silver oxide ($Ag_2O$), a part of the bismuth oxide ($Bi_2O_3$) and a part of the cobalt oxide ($Co_2O_3$) in the form of borosilicate bismuth glass with cobalt oxide.

EXAMPLE 4-1

Zinc oxide and additives of Table 22 and 23 were fabricated into voltage-dependent resistors by the same process as that of Example 1-1. The electrical properties of the resultant resistors are shown in Tables 22 and 23 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges are shown.

Tables 22 and 23 show that an n-value above 40, a residual voltage ratio below 1.70, a surge withstand capability below −4.0 percent, a thermal run away life under voltage stress with surges more than 100 hours can be obtained when said sintered body comprises, as a main constituent, zinc oxide (ZnO), and as additives, 0.1 to 3.0 mole percent of bismuth oxide ($Bi_2O_3$), 0.1 to 3.0 mole percent of cobalt oxide ($Co_2O_3$), 0.1 to 3.0 mole percent of manganese oxide ($MnO_2$), 0.1 to 3.0 mole percent of antimony oxide ($Sb_2O_3$), 0.05 to 1.5 mole percent of chromium oxide ($Cr_2O_3$), 0.005 to 0.3 mole percent of boron oxide ($B_2O_3$), and at least one member selected from the group of 0.0005 to 0.025 mole percent of aluminum oxide ($Al_2O_3$) and 0.0005 to 0.025 mole percent of gallium oxide ($Ga_2O_3$), 0.1 to 3.0 mole percent of nickel oxide (NiO) and 0.0005 to 0.3 mole percent of silver oxide ($Ag_2O$).

EXAMPLE 4-2

Zinc oxide and additives of No. a-1 or No. b-1 in Table 17 and 18 and glass frits whose composition is shown in Table 11 were fabricated into voltage dependent resistors by the same process as that of Example 1-1. The electrical properties of the resultant resistors are shown in Table 24 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 24 shows an improvement of the n-value of more than 10 and an improvement in the thermal run away life more than 20 hours.

It has been discovered according to the present invention that the n-value is improved from above 40 to above 50 and the thermal run away life under voltage stress with surges is improved from more than 100 to more than 120 hours by adding an additives, the entire amount of boron oxide ($B_2O_3$) and the entire amount of silver oxide ($Ag_2O$) in the form of borosilicate glass with silver oxide.

EXAMPLE 4-3

Zinc oxide and additives of No. 17 or No. 18 in Table 17 and 18 and glass frits whose composition is shown in Table 13 were fabricated into voltage dependent resistors by the same process as that of Example 1-1. The electrical properties of the resultant resistors are shown in Table 25 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 25 shows an improvement of the n-value of more than 10 and an improvement in the thermal run away life of more than 30 hours.

Table 25 shows that the n-value is improved from above 40 to above 50 and the thermal run away life under voltage stress with surges is improved from more than 100 to more than 130 by adding the additives of the entire amount of boron oxide ($B_2O_3$), all amount of the silver oxide ($Ag_2O$), and a part of bismuth oxide ($Bi_2O_3$) in the form of borosilicate bismuth glass with silver oxide.

EXAMPLE 4-4

Zinc oxide and additives of No. a-1 or No. b-1 in Table 17 and 18 and glass frits whose composition is shown in Table 15 were fabricated into voltage dependent resistors by the same process as that of Example 1-1. The electrical properties of the resultant resistors are shown in Table 26 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 26 shows an improvement of n-value of the more than 20 and an improvement in the thermal run away life more than 30 hours.

Table 26 shows that the n-value is improved from above 40 to above 60 and the thermal run away life under voltage stress with surges is improved from more than 100 to more than 130 hours by adding as additives, the entire amount of boron oxide ($B_2O_3$), the entire amount of silver oxide ($Ag_2O$), a part of the bismuth oxide ($BiO_3$) and a part of cobalt oxide ($Co_2O_3$) in the form of borosilicate glass with silver oxide and cobalt oxide.

EXAMPLE 5-1

Zinc oxide and additives of Table 27 and 28 were fabricated into voltage-dependent resistors by the same process as that of Example 1-1. The electrical properties of the resultant resistors are shown in Tables 27 and 28 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges are shown.

Tables 27 and 28 show that an n-value above 40, a residual voltage ratio below 1.60, a surge withstand capability below −3.0 percent, a thermal run away life under voltage stress with surges more than 150 hours can be obtained when said sintered body comprises, as a main constituent, zinc oxide (ZnO), and as additives, 0.1 to 3.0 mole percent of bismuth oxide ($Bi_2O_3$), 0.1 to 3.0 mole percent of cobalt oxide ($Co_2O_3$), 0.1 to 3.0 mole percent of manganese oxide ($MnO_2$), 0.1 to 3.0 mole percent of antimony oxide ($Sb_2O_3$), 0.05 to 1.5 mole percent of chromium oxide ($Cr_2O_3$), 0.005 to 0.3 mole percent of boron oxide ($B_2O_3$), and at least one member selected from the group of 0.0005 to 0.025 mole percent of aluminum oxide ($Al_2O_3$) and 0.0005 to 0.025 mole percent of gallium oxide ($Ga_2O_3$), and both of 0.1 to 3.0 mole percent of nickel oxide (NiO) and 0.1 to 10.0 mole percent of silicon oxide ($SiO_2$).

EXAMPLE 5-2

Zinc oxide and additives of No. a-1 or No. b-1 in Table 27 and 28 and glass frits whose composition is shown in Table 3 were fabricated into voltage dependent resistors by the same process as that of Example 1-1. The electrical properties of the resultant resistors are shown in Table 29 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 29 shows an improvement of the n-value of more than 10 and an improvement in the thermal run away life of more than 10 hour.

Table 29 shows that the n-value is improved from above 40 to above 50 and the thermal run away life under voltage stress with surges is improved from more than 150 to more than 160 by adding as additives, the entire amount of boron oxide ($B_2O_3$), and a part of the silicon oxide ($SiO_2$) in the form of borosilicate glass.

EXAMPLE 5-3

Zinc oxide and additives of No. a-1 or No. b-1 in Table 27 and 28 and glass frits whose composition is shown in Table 5 were fabricated into voltage dependent resistors by the same process as that of Example 1-1. The electrical properties of the resultant resistors are shown in Table 30 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 30 shows improvement of n-value of more than 10 and an improvement in the thermal run away life of more than 20 hours.

Table 30 shows that the n-value is improved from above 40 to above 50 and the thermal run away life under voltage stress with surges is improved from more than 150 to more than 170 hours by adding as additives, the entire amount of boron oxide ($B_2O_3$), and a part of the bismuth oxide ($Bi_2O_3$) in the form of the borosilicate bismuth glass.

EXAMPLE 5-4

Zinc oxide and additives of No. a-1 or No. b-1 in Table 27 and 28 and glass frits whose composition is shown in Table 7 were fabricated into voltage dependent resistors by the same process as that of Example 1-1. The electrical properties of the resultant resistors are shown in Table 31 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 31 shows that the improvement of n-value of more than 20 and the improvement of the thermal run away life more than 20 hours.

Table 31 shows that the n-value is improved from above 40 to above 60 and the thermal run away life under voltage stress with surges is improved from more than 150 to more than 170 by adding the additives of all amount of boron oxide ($B_2O_3$), a part of bismuth oxide ($Bi_2O_3$) and a part of cobalt oxide ($Co_2O_3$) in the form of borosilicate bismuth glass with cobalt oxide.

EXAMPLE 6-1

Zinc oxide and additives of Table 32 and 33 were fabricated into voltage-dependent resistors by the same process as that of Example 1-1. The electrical properties of the resultant resistors are shown in Tables 32 and 33 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges are shown.

Tables 32 and 33 show that an n-value above 50, a residual voltage ratio below 1.60, a surge withstand capability below −3.0 percent, a thermal run away life under voltage stress with surges for more than 190 hours can be obtained when said sintered body comprises, as a main constituent, zinc oxide (ZnO), and as additives, 0.1 to 3.0 mole percent of bismuth oxide ($Bi_2O_3$), 0.1 to 3.0 mole percent of cobalt oxide ($Co_2O_3$), 0.1 to 3.0 mole percent of manganese oxide ($MnO_2$), 0.1 to 3.0 mole percent of antimony oxide ($Sb_2O_3$), 0.05 to 1.5 mole percent of chromium oxide ($Cr_2O_3$), 0.005 to 0.3 mole percent of boron oxide ($B_2O_3$), and at least one member selected from the group of 0.0005 to 0.025 mole percent of aluminum oxide ($Al_2O_3$) and 0.0005 to 0.025 mole percent of gallium oxide ($Ga_2O_3$), and both 0.1 to 3.0 mole percent of nickel oxide (NiO) and 0.1 to 10.0 mole percent of silicon oxide ($SiO_2$) and 0.0005 to 0.3 mole percent of silver oxide ($Ag_2O$).

EXAMPLE 6-2

Zinc oxide and additives of No. a-1 or No. b-1 in Table 27 and 28 and glass frits whose composition is shown in Table 15 were fabricated into voltage dependent resistors by the same process as that of Example 1-1. The electrical properties of the resultant resistors are shown in Table 34 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 34 shows an improvement of n-value of more than 10 and an improvement in the thermal run away life more than 20 hours.

Table 34 shows that the n-value is improved from above 50 to above 60 and the thermal run away life under voltage stress with surges is improved from more than 190 to more than 210 hours by adding as additives, the entire amount of boron oxide ($B_2O_3$) and the entire amount of the silver oxide ($Ag_2O$) in the form of borosilicate glass with silver oxide.

EXAMPLE 6-3

Zinc oxide and additives of No. a-1 or No. b-1 in Table 27 and 28 and glass frits whose composition is shown in Table 13 were fabricated into voltage dependent resistors by the same process as that of Example 1-1. The electrical properties of the resultant resistors are shown in Table 35 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 35 shows an improvement of the n-value of more than 10 and an improvement in the thermal run away of life more than 30 hours.

Table 35 shows that the n-value is improved from above 50 to above 60 and the thermal run away life under voltage stress with surges is improved from more than 190 to more than 220 by adding as additives, the entire amount of the boron oxide ($B_2O_3$), the entire amount of the silver oxide ($Ag_2O$) and a part of the bismuth oxide ($Bi_2O_3$) in the form of borosilicate bismuth glass with silver oxide.

EXAMPLE 6-4

Zinc oxide and additives of No. a-1 or No. b-1 in Table 27 and 28 and glass frits whose composition is shown in Table 19 were fabricated into voltage dependent resistors by the same process as that of Example 1-1. The electrical properties of the resultant resistors are shown in Table 36 in which the C-values of unit thickness (1 mm), the n-values defined between 0.1 mA and 1 mA, and the residual voltage ratios of $V_{100\,A}$ to $V_{1\,mA}$, the change rates of C-value after impulse test and the thermal run away lives under continuous voltage stress with surges. Table 36 shows an improvement of n-value of more than 20 and an improvement in the thermal run away life more than 30 hours.

Table 36 shows that the n-value is improved from above 50 to above 70 and the thermal run away life under voltage stress with surges is improved from more than 190 to more than 220 by adding as additives, the entire amount of boron oxide ($B_2O_3$), all amount of the silver oxide ($Ag_2O$), a part of bismuth oxide ($Bi_2O_3$) and a part of cobalt oxide ($Co_2O_3$) in the form of borosilicate bismuth glass with silver oxide and cobalt oxide.

TABLE 3

| Glass composition No. | $B_2O_3$ | $SiO_2$ |
|---|---|---|
| A1 | 5 | 95 |
| A2 | 15 | 85 |
| A3 | 30 | 70 |
| | | (Wt. %) |

TABLE 1

| No. | Additives (mole %) $Bi_2O_3$ | $Co_2O_3$ | $MnO_2$ | $Sb_2O_3$ | $Cr_2O_3$ | $SiO_2$ | $Al_2O_3$ | $B_2O_3$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|
| a-1 | 0.5 | 0.5 | 0.5 | 1.0 | 0.5 | 0.5 | 0.0025 | 0 | 212 | 50 | 1.47 | −5.2 | 9 |
| a-2 | " | " | " | " | " | " | " | 0.005 | 211 | 53 | 1.45 | −3.9 | 52 |
| a-3 | " | " | " | " | " | " | " | 0.3 | 211 | 55 | 1.46 | −4.5 | 58 |
| a-4 | " | " | " | " | " | " | 0 | 0.1 | 211 | 54 | 1.71 | −6.5 | 7 |
| a-5 | " | " | " | " | " | " | 0.0005 | " | 210 | 53 | 1.47 | −2.9 | 53 |
| a-6 | " | " | " | " | " | " | 0.025 | " | 221 | 45 | 1.53 | −2.9 | 55 |
| a-7 | " | " | " | " | " | 0 | 0.0025 | " | 149 | 51 | 1.53 | −5.3 | 43 |
| a-8 | " | " | " | " | " | 0.1 | " | " | 175 | 59 | 1.49 | −4.5 | 53 |
| a-9 | " | " | " | " | " | 10.0 | " | " | 433 | 59 | 1.45 | −2.8 | 55 |
| a-10 | " | " | " | " | 0 | 0.5 | " | " | 185 | 52 | 1.54 | −6.1 | 47 |
| a-11 | " | " | " | " | 0.05 | " | " | " | 190 | 53 | 1.52 | −3.5 | 53 |
| a-12 | " | " | " | " | 1.5 | " | " | " | 232 | 45 | 1.56 | −4.4 | 53 |
| a-13 | " | " | " | 0 | 0.5 | " | " | " | 174 | 42 | 1.53 | −6.5 | 45 |
| a-14 | " | " | " | 0.1 | " | " | " | " | 188 | 51 | 1.48 | −3.5 | 52 |
| a-15 | " | " | " | 3.0 | " | " | " | " | 251 | 55 | 1.49 | −3.4 | 54 |
| a-16 | " | " | 0 | 1.0 | " | " | " | " | 149 | 27 | 1.73 | −6.3 | 51 |
| a-17 | " | " | 0.1 | " | " | " | " | " | 202 | 50 | 1.52 | −4.1 | 41 |
| a-18 | " | " | 3.0 | " | " | " | " | " | 210 | 48 | 1.53 | −4.0 | 52 |
| a-19 | " | 0 | 0.5 | " | " | " | " | " | 132 | 29 | 1.73 | −6.5 | 42 |
| a-20 | " | 0.1 | " | " | " | " | " | " | 178 | 43 | 1.56 | −3.8 | 51 |
| a-21 | " | 3.0 | " | " | " | " | " | " | 221 | 56 | 1.56 | −3.9 | 53 |
| a-22 | 0 | 0.5 | " | " | " | " | " | " | 96 | 6 | 3.60 | −6.5 | 35 |
| a-23 | 0.1 | " | " | " | " | " | " | " | 175 | 43 | 1.51 | −3.8 | 52 |
| a-24 | 1.0 | " | " | " | " | " | " | " | 205 | 59 | 1.51 | −4.2 | 56 |
| a-25 | 3.0 | " | " | " | " | " | " | " | 204 | 58 | 1.52 | −4.3 | 58 |
| a-26 | 0.5 | " | " | " | " | " | " | " | 210 | 53 | 1.50 | −4.5 | 57 |

TABLE 2

| No. | Additives (mole %) $Bi_2O_3$ | $Co_2O_3$ | $MnO_2$ | $Sb_2O_3$ | $Cr_2O_3$ | $SiO_2$ | $Al_2O_3$ | $B_2O_3$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|
| b-1 | 0.5 | 0.5 | 0.5 | 1.0 | 0.5 | 0.5 | 0.0025 | 0 | 211 | 51 | 1.47 | −5.3 | 8 |
| b-2 | " | " | " | " | " | " | " | 0.005 | 211 | 53 | 1.47 | −4.0 | 53 |
| b-3 | " | " | " | " | " | " | " | 0.3 | 210 | 54 | 1.47 | −4.6 | 58 |
| b-4 | " | " | " | " | " | " | 0 | 0.1 | 212 | 54 | 1.70 | −6.7 | 8 |
| b-5 | " | " | " | " | " | " | 0.0005 | " | 210 | 53 | 1.47 | −3.3 | 53 |
| b-6 | " | " | " | " | " | " | 0.025 | " | 222 | 43 | 1.52 | −3.3 | 56 |
| b-7 | " | " | " | " | " | 0 | 0.0025 | " | 150 | 51 | 1.52 | −5.5 | 44 |
| b-8 | " | " | " | " | " | 0.1 | " | " | 173 | 58 | 1.49 | −4.6 | 53 |
| b-9 | " | " | " | " | " | 10.0 | " | " | 431 | 58 | 1.44 | −2.9 | 53 |
| b-10 | " | " | " | " | 0 | 0.5 | " | " | 183 | 51 | 1.53 | −6.1 | 48 |
| b-11 | " | " | " | " | 0.05 | " | " | " | 191 | 52 | 1.52 | −3.7 | 52 |
| b-12 | " | " | " | " | 1.5 | " | " | " | 230 | 44 | 1.55 | −4.4 | 52 |
| b-13 | " | " | " | 0 | 0.5 | " | " | " | 173 | 42 | 1.53 | −6.3 | 44 |
| b-14 | " | " | " | 0.1 | " | " | " | " | 189 | 50 | 1.48 | −3.5 | 51 |
| b-15 | " | " | " | 3.0 | " | " | " | " | 252 | 53 | 1.48 | −3.5 | 53 |
| b-16 | " | " | 0 | 1.0 | " | " | " | " | 150 | 25 | 1.72 | −6.3 | 41 |
| b-17 | " | " | 0.1 | " | " | " | " | " | 201 | 49 | 1.51 | −4.1 | 50 |
| b-18 | " | " | 3.0 | " | " | " | " | " | 210 | 47 | 1.53 | −4.1 | 50 |
| b-19 | " | 0 | 0.5 | " | " | " | " | " | 131 | 26 | 1.73 | −6.5 | 41 |
| b-20 | " | 0.1 | " | " | " | " | " | " | 178 | 41 | 1.56 | −3.8 | 50 |
| b-21 | " | 3.0 | " | " | " | " | " | " | 219 | 53 | 1.56 | −3.7 | 50 |
| b-22 | 0 | 0.5 | " | " | " | " | " | " | 97 | 6 | 3.55 | −6.0 | 37 |
| b-23 | 0.1 | " | " | " | " | " | " | " | 173 | 43 | 1.51 | −3.8 | 51 |
| b-24 | 1.0 | " | " | " | " | " | " | " | 206 | 57 | 1.51 | −4.1 | 56 |
| b-25 | 3.0 | " | " | " | " | " | " | " | 203 | 57 | 1.52 | −4.5 | 57 |
| b-26 | 0.5 | " | " | " | " | " | " | " | 212 | 54 | 1.50 | −4.7 | 55 |

TABLE 4

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | A1 | 233 | 63 | 146 | −4.2 | 77 |
| | A2 | 226 | 63 | 1.46 | −4.1 | 77 |
| | A3 | 221 | 64 | 1.46 | −3.8 | 78 |
| b-1 | A1 | 235 | 64 | 1.46 | −4.1 | 77 |
| | A2 | 227 | 64 | 1.46 | −4.1 | 77 |
| | A3 | 220 | 64 | 1.46 | −4.0 | 78 |

TABLE 5

| Glass Composition | $B_2O_3$ | $SiO_2$ | $Bi_2O_3$ |
|---|---|---|---|
| B1 | 5 | 5 | 90 |
| B2 | 20 | 10 | 70 |
| B3 | 30 | 30 | 40 |
| | | | (Wt. %) |

TABLE 6

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | B1 | 211 | 64 | 1.46 | −4.1 | 88 |
| | B2 | 212 | 64 | 1.46 | −3.8 | 88 |
| | B3 | 213 | 63 | 1.46 | −3.6 | 88 |
| b-1 | B1 | 210 | 64 | 1.47 | −4.1 | 87 |
| | B2 | 211 | 64 | 1.46 | −3.9 | 88 |

TABLE 6-continued

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| | B3 | 213 | 64 | 1.46 | −3.8 | 88 |

TABLE 7

| Glass Composition No. | $B_2O_3$ | $SiO_2$ | $Bi_2O_3$ | $Co_2O_3$ |
|---|---|---|---|---|
| E1 | 5 | 8 | 85 | 2 |
| E2 | 10 | 5 | 75 | 10 |
| E3 | 10 | 15 | 70 | 5 |
| E4 | 25 | 25 | 40 | 10 |
| | | | | (Wt. %) |

TABLE 8

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | E1 | 211 | 75 | 1.46 | −3.7 | 88 |
| | E2 | 211 | 73 | 1.46 | −3.7 | 88 |
| | E3 | 211 | 74 | 1.47 | −3.6 | 89 |
| | E4 | 213 | 74 | 1.46 | −3.6 | 89 |
| b-1 | E1 | 211 | 74 | 1.47 | −3.8 | 88 |
| | E2 | 211 | 74 | 1.47 | −3.7 | 88 |
| | E3 | 212 | 74 | 1.47 | −3.7 | 89 |
| | E4 | 213 | 74 | 1.47 | −3.8 | 88 |

TABLE 9

| No. | Additives (mole %) $Bi_2O_3$ | $Co_2O_3$ | $MnO_2$ | $Sb_2O_3$ | $Cr_2O_3$ | $SiO_2$ | $Al_2O_3$ | $B_2O_3$ | $Ag_2O_3$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|---|
| c-1 | 0.5 | 0.5 | 0.5 | 1.0 | 0.5 | 0.5 | 0.0025 | 0.1 | 0 | 210 | 53 | 1.50 | −4.5 | 57 |
| c-2 | " | " | " | " | " | " | " | " | 0.0005 | 211 | 58 | 1.48 | −4.3 | 103 |
| c-3 | " | " | " | " | " | " | " | " | 0.1 | 211 | 63 | 1.49 | −4.4 | 105 |
| c-4 | " | " | " | " | " | " | " | " | 0.3 | 213 | 65 | 1.48 | −4.7 | 107 |
| c-5 | " | " | " | " | " | " | " | 0 | 0.1 | 211 | 55 | 1.47 | −5.2 | 19 |
| c-6 | " | " | " | " | " | " | " | 0.005 | " | 211 | 58 | 1.45 | −4.0 | 102 |
| c-7 | " | " | " | " | " | " | " | 0.3 | " | 211 | 59 | 1.45 | −4.4 | 107 |
| c-8 | " | " | " | " | " | " | 0 | 0.1 | " | 210 | 58 | 1.73 | −6.6 | 18 |
| c-9 | " | " | " | " | " | " | 0.0005 | " | " | 210 | 55 | 1.45 | −3.0 | 100 |
| c-10 | " | " | " | " | " | " | 0.025 | " | " | 222 | 51 | 1.53 | −3.0 | 105 |
| c-11 | " | " | " | " | " | 0 | 0.0025 | " | " | 150 | 53 | 1.53 | −5.2 | 53 |
| c-12 | " | " | " | " | " | 0.1 | " | " | " | 177 | 62 | 1.45 | −4.5 | 104 |
| c-13 | " | " | " | " | " | 10.0 | " | " | " | 440 | 62 | 1.46 | −2.9 | 106 |
| c-14 | " | " | " | " | 0 | 0.5 | " | " | " | 183 | 55 | 1.54 | −5.8 | 49 |
| c-15 | " | " | " | " | 0.05 | " | " | " | " | 191 | 55 | 1.54 | −3.5 | 102 |
| c-16 | " | " | " | " | 1.5 | " | " | " | " | 233 | 50 | 1.57 | −4.3 | 103 |
| c-17 | " | " | " | 0 | 0.5 | " | " | " | " | 170 | 51 | 1.54 | −6.4 | 49 |
| c-18 | " | " | " | 0.1 | " | " | " | " | " | 185 | 56 | 1.49 | −3.3 | 103 |
| c-19 | " | " | " | 3.0 | " | " | " | " | " | 252 | 59 | 1.49 | −3.3 | 105 |
| c-20 | " | " | 0 | 1.0 | " | " | " | " | " | 151 | 29 | 1.72 | −6.7 | 39 |
| c-21 | " | " | 0.1 | " | " | " | " | " | " | 205 | 53 | 1.52 | −4.0 | 100 |
| c-22 | " | " | 3.0 | " | " | " | " | " | " | 213 | 54 | 151 | −4.0 | 101 |
| c-23 | " | 0 | 0.5 | " | " | " | " | " | " | 135 | 28 | 1.74 | −6.3 | 45 |
| c-24 | " | 0.1 | " | " | " | " | " | " | " | 181 | 51 | 1.55 | −3.9 | 103 |
| c-25 | " | 3.0 | " | " | " | " | " | " | " | 221 | 59 | 1.55 | −3.8 | 103 |
| c-26 | 0 | 0.5 | " | " | " | " | " | " | " | 99 | 6 | 3.55 | −6.4 | 43 |
| c-27 | 0.1 | " | " | " | " | " | " | " | " | 174 | 50 | 1.53 | −3.8 | 103 |
| c-28 | 1.0 | " | " | " | " | " | " | " | " | 204 | 63 | 1.53 | −4.0 | 107 |
| c-29 | 3.0 | " | " | " | " | " | " | " | " | 205 | 62 | 1.53 | −4.1 | 109 |
| c-30 | 0.5 | " | " | " | " | " | " | " | " | 211 | 55 | 1.51 | −4.7 | 106 |

TABLE 10

| No. | Additives (mole %) $Bi_2O_3$ | $Co_2O_3$ | $MnO_2$ | $Sb_2O_3$ | $Cr_2O_3$ | $SiO_2$ | $Al_2O_3$ | $B_2O_3$ | $Ag_2O_3$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|---|
| d-1 | 0.5 | 0.5 | 0.5 | 1.0 | 0.5 | 0.5 | 0.0025 | 0.1 | 0 | 212 | 54 | 1.50 | −4.7 | 55 |
| d-2 | " | " | " | " | " | " | " | " | 0.0005 | 211 | 58 | 1.49 | −4.3 | 104 |
| d-3 | " | " | " | " | " | " | " | " | 0.1 | 211 | 62 | 1.49 | −4.4 | 106 |
| d-4 | " | " | " | " | " | " | " | " | 0.3 | 211 | 64 | 1.49 | −4.6 | 108 |
| d-5 | " | " | " | " | " | " | " | 0 | 0.1 | 211 | 53 | 1.48 | −5.3 | 19 |
| d-6 | " | " | " | " | " | " | " | 0.005 | " | 210 | 57 | 1.46 | −4.1 | 101 |
| d-7 | " | " | " | " | " | " | " | 0.3 | " | 210 | 57 | 1.46 | −4.4 | 106 |
| d-8 | " | " | " | " | " | " | 0 | 0.1 | " | 210 | 57 | 1.73 | −6.5 | 21 |
| d-9 | " | " | " | " | " | " | 0.0005 | " | " | 211 | 54 | 1.48 | −3.3 | 101 |
| d-10 | " | " | " | " | " | " | 0.025 | " | " | 224 | 51 | 1.53 | −3.0 | 106 |
| d-11 | " | " | " | " | " | 0 | 0.0025 | " | " | 153 | 53 | 1.52 | −5.5 | 51 |
| d-12 | " | " | " | " | " | 0.1 | " | " | " | 181 | 60 | 1.48 | −4.3 | 105 |
| d-13 | " | " | " | " | " | 10.0 | " | " | " | 437 | 61 | 1.47 | −3.1 | 108 |
| d-14 | " | " | " | " | 0 | 0.5 | " | " | " | 182 | 54 | 1.55 | −6.2 | 47 |
| d-15 | " | " | " | " | 0.05 | " | " | " | " | 180 | 55 | 1.55 | −3.9 | 102 |
| d-16 | " | " | " | " | 1.5 | " | " | " | " | 225 | 51 | 1.57 | −4.8 | 104 |
| d-17 | " | " | " | 0 | 0.5 | " | " | " | " | 172 | 51 | 1.54 | −6.5 | 47 |
| d-18 | " | " | " | 0.1 | " | " | " | " | " | 186 | 57 | 1.50 | −3.3 | 103 |
| d-19 | " | " | " | 3.0 | " | " | " | " | " | 253 | 59 | 1.50 | −3.4 | 106 |
| d-20 | " | " | 0 | 1.0 | " | " | " | " | " | 150 | 27 | 1.73 | −6.8 | 38 |
| d-21 | " | " | 0.1 | " | " | " | " | " | " | 205 | 52 | 1.52 | −4.2 | 102 |
| d-22 | " | " | 3.0 | " | " | " | " | " | " | 213 | 52 | 152 | −4.2 | 102 |
| d-23 | " | 0 | 0.5 | " | " | " | " | " | " | 135 | 27 | 1.74 | −6.3 | 44 |
| d-24 | " | 0.1 | " | " | " | " | " | " | " | 181 | 50 | 1.55 | −3.9 | 104 |
| d-25 | " | 3.0 | " | " | " | " | " | " | " | 221 | 57 | 1.55 | −3.8 | 104 |
| d-26 | 0 | 0.5 | " | " | " | " | " | " | " | 95 | 6 | 3.65 | −6.5 | 43 |
| d-27 | 0.1 | " | " | " | " | " | " | " | " | 175 | 51 | 1.54 | −3.8 | 103 |
| d-28 | 1.0 | " | " | " | " | " | " | " | " | 203 | 62 | 1.53 | −4.1 | 108 |
| d-29 | 3.0 | " | " | " | " | " | " | " | " | 206 | 62 | 1.54 | −4.1 | 109 |
| d-30 | 0.5 | " | " | " | " | " | " | " | " | 210 | 54 | 1.50 | −4.5 | 107 |

TABLE 11

| Glass Composition No. | $B_2O_3$ | $SiO_2$ | $Ag_2O$ |
|---|---|---|---|
| F1 | 5 | 90 | 5 |
| F2 | 17 | 80 | 3 |
| F3 | 30 | 45 | 25 |

(Wt. %)

TABLE 12

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | F1 | 228 | 73 | 1.46 | −3.9 | 127 |
| | F2 | 223 | 73 | 1.46 | −3.8 | 127 |
| | F3 | 215 | 73 | 1.46 | −3.9 | 127 |
| b-1 | F1 | 227 | 74 | 1.46 | −3.9 | 127 |
| | F2 | 223 | 75 | 1.47 | −3.8 | 127 |
| | F3 | 214 | 74 | 1.46 | −3.9 | 127 |

TABLE 13

| Glass Composition No. | $B_2O_3$ | $SiO_2$ | $Bi_2O_3$ | $Ag_2O$ |
|---|---|---|---|---|
| $G_1$ | 5 | 7 | 85 | 3 |
| $G_2$ | 20 | 10 | 50 | 20 |
| $G_3$ | 25 | 25 | 45 | 5 |
| $G_4$ | 10 | 10 | 55 | 25 |

(Wt. %)

TABLE 14

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | $G_1$ | 211 | 74 | 1.47 | −4.1 | 137 |
| | $G_2$ | 211 | 73 | 1.47 | −4.0 | 139 |
| | $G_3$ | 210 | 73 | 1.47 | −4.0 | 139 |
| | $G_4$ | 210 | 74 | 1.46 | −4.0 | 137 |
| b-1 | $G_1$ | 211 | 75 | 1.47 | −4.2 | 137 |
| | $G_2$ | 210 | 74 | 1.47 | −4.3 | 138 |
| | $G_3$ | 211 | 74 | 1.48 | −4.3 | 138 |
| | $G_4$ | 211 | 75 | 1.46 | −4.3 | 137 |

TABLE 15

| Glass Composition No. | $B_2O_3$ | $SiO_2$ | $Bi_2O_3$ | $Co_2O_3$ | $Ag_2O$ |
|---|---|---|---|---|---|
| $J_1$ | 5 | 5 | 85 | 2 | 3 |
| $J_2$ | 10 | 10 | 60 | 10 | 10 |
| $J_3$ | 25 | 25 | 45 | 2 | 3 |
| $J_4$ | 10 | 10 | 50 | 5 | 25 |

(wt. %)

TABLE 16

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | $J_1$ | 211 | 83 | 1.46 | −3.5 | 137 |
| | $J_2$ | 211 | 84 | 1.46 | −3.5 | 138 |
| | $J_3$ | 214 | 84 | 1.47 | −3.7 | 137 |
| | $J_4$ | 212 | 85 | 1.46 | −3.8 | 139 |
| b-1 | $J_1$ | 211 | 84 | 1,46 | −3.8 | 138 |
| | $J_2$ | 212 | 85 | 1.47 | −3.7 | 138 |
| | $J_3$ | 214 | 86 | 1.47 | −3.9 | 138 |
| | $J_4$ | 212 | 86 | 1.47 | −4.1 | 139 |

TABLE 17

| No. | Additives (mole %) $Bi_2O_3$ | $Co_2O_3$ | $MnO_2$ | $Sb_2O_3$ | $Cr_2O_3$ | NiO | $Al_2O_3$ | $B_2O_3$ | C-value (V/mm) | n-value | $V_{100A}/V_{1mA}$ | Change rate after Impulse test (%) | Thermal run away life (hr) |
|---|---|---|---|---|---|---|---|---|---|---|---|---|---|
| a-1 | 0.5 | 0.5 | 0.5 | 1.0 | 0.5 | 1.0 | 0.0025 | 0 | 151 | 46 | 1.55 | −5.8 | 8 |
| a-2 | " | " | " | " | " | " | " | 0.005 | 151 | 46 | 1.52 | −3.0 | 52 |
| a-3 | " | " | " | " | " | " | " | 0.3 | 152 | 47 | 1.53 | −29 | 53 |
| a-4 | " | " | " | " | " | " | 0 | 0.1 | 151 | 47 | 1.83 | −6.8 | 7 |
| a-5 | " | " | " | " | " | " | 0.0005 | " | 151 | 44 | 1.63 | −2.0 | 53 |
| a-6 | " | " | " | " | " | " | 0.025 | " | 157 | 38 | 1.64 | −2.0 | 52 |
| a-7 | " | " | " | " | " | 0 | 0.0025 | " | 150 | 48 | 1.38 | −4.6 | 43 |
| a-8 | " | " | " | " | " | 0.1 | " | " | 151 | 49 | 1.60 | −3.5 | 51 |
| a-9 | " | " | " | " | " | 3.0 | " | " | 165 | 40 | 1.63 | −2.5 | 54 |
| a-10 | " | " | " | " | 0 | 1.0 | " | " | 135 | 51 | 1.63 | −6.8 | 43 |
| a-11 | " | " | " | " | 0.05 | " | " | " | 141 | 51 | 1.60 | −3.5 | 53 |
| a-12 | " | " | " | " | 1.5 | " | " | " | 173 | 40 | 1.63 | −3.6 | 51 |
| a-13 | " | " | " | 0 | 0.5 | " | " | " | 126 | 37 | 1.63 | −7.3 | 44 |
| a-14 | " | " | " | 0.1 | " | " | " | " | 134 | 49 | 1.58 | −3.4 | 53 |
| a-15 | " | " | " | 3.0 | " | " | " | " | 193 | 53 | 1.58 | −3.3 | 55 |
| a-16 | " | " | 0 | 1.0 | " | " | " | " | 103 | 25 | 1.84 | −7.3 | 41 |
| a-17 | " | " | 0.1 | " | " | " | " | " | 123 | 46 | 1.60 | −3.4 | 52 |
| a-18 | " | " | 3.0 | " | " | " | " | " | 144 | 48 | 1.62 | −3.4 | 54 |
| a-19 | " | 0 | 0.5 | " | " | " | " | " | 102 | 25 | 1.88 | −7.2 | 35 |
| a-20 | " | 0.1 | " | " | " | " | " | " | 143 | 31 | 1.63 | −3.1 | 57 |
| a-21 | " | 3.0 | " | " | " | " | " | " | 163 | 45 | 1.64 | −3.5 | 56 |
| a-22 | 0 | 0.5 | " | " | " | " | " | " | 84 | 6 | 3.62 | −7.3 | 38 |
| a-23 | 0.1 | " | " | " | " | " | " | " | 153 | 38 | 1.61 | −3.3 | 57 |
| a-24 | 1.0 | " | " | " | " | " | " | " | 153 | 55 | 1.62 | −3.3 | 56 |
| a-25 | 3.0 | " | " | " | " | " | " | " | 148 | 54 | 1.62 | −3.4 | 55 |
| a-26 | 0.5 | " | " | " | " | " | " | " | 153 | 52 | 1.53 | −3.3 | 55 |

TABLE 18

| No. | Additives (mole %) $Bi_2O_3$ | $Co_2O_3$ | $MnO_2$ | $Sb_2O_3$ | $Cr_2O_3$ | NiO | $Gd_2O_3$ | $B_2O_3$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|
| b-1 | 0.5 | 0.5 | 0.5 | 1.0 | 0.5 | 1.0 | 0.0025 | 0 | 150 | 47 | 1.54 | −5.5 | 7 |
| b-2 | " | " | " | " | " | " | " | 0.005 | 150 | 46 | 1.54 | −3.1 | 51 |
| b-3 | " | " | " | " | " | " | " | 0.3 | 151 | 47 | 1.54 | −3.1 | 53 |
| b-4 | " | " | " | " | " | " | 0 | 0.1 | 152 | 46 | 1.82 | −6.5 | 7 |
| b-5 | " | " | " | " | " | " | 0.0005 | " | 153 | 43 | 1.65 | −2.1 | 54 |
| b-6 | " | " | " | " | " | " | 0.025 | " | 155 | 39 | 1.65 | −2.1 | 52 |
| b-7 | " | " | " | " | " | 0 | 0.0025 | " | 150 | 44 | 1.59 | −4.7 | 41 |
| b-8 | " | " | " | " | " | 0.1 | " | " | 150 | 45 | 1.61 | −3.6 | 52 |
| b-9 | " | " | " | " | " | 3.0 | " | " | 163 | 40 | 1.63 | −2.5 | 55 |
| b-10 | " | " | " | " | 0 | 1.0 | " | " | 134 | 51 | 1.62 | −6.5 | 42 |
| b-11 | " | " | " | " | 0.05 | " | " | " | 140 | 50 | 1.61 | −3.4 | 54 |
| b-12 | " | " | " | " | 1.5 | " | " | " | 172 | 42 | 1.62 | −3.4 | 52 |
| b-13 | " | " | " | 0 | 0.5 | " | " | " | 123 | 36 | 1.62 | −7.1 | 45 |
| b-14 | " | " | " | 0.1 | " | " | " | " | 136 | 48 | 1.59 | −3.3 | 55 |
| b-15 | " | " | " | 3.0 | " | " | " | " | 191 | 53 | 1.59 | −3.3 | 57 |
| b-16 | " | " | 0 | 1.0 | " | " | " | " | 102 | 26 | 1.83 | −7.2 | 42 |
| b-17 | " | " | 0.1 | " | " | " | " | " | 121 | 47 | 1.61 | −3.5 | 52 |
| b-18 | " | " | 3.0 | " | " | " | " | " | 139 | 47 | 1.61 | −3.4 | 55 |
| b-19 | " | 0 | 0.5 | " | " | " | " | " | 101 | 26 | 1.83 | −7.0 | 33 |
| b-20 | " | 0.1 | " | " | " | " | " | " | 143 | 32 | 1.63 | −3.0 | 57 |
| b-21 | " | 3.0 | " | " | " | " | " | " | 165 | 46 | 1.65 | −3.4 | 56 |
| b-22 | 0 | 0.5 | " | " | " | " | " | " | 85 | 6 | 3.55 | −7.5 | 38 |

TABLE 18-continued

| No. | Additives (mole %) $Bi_2O_3$ | $Co_2O_3$ | $MnO_2$ | $Sb_2O_3$ | $Cr_2O_3$ | NiO | $Gd_2O_3$ | $B_2O_3$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|
| b-23 | 0.1 | " | " | " | " | " | " | " | 153 | 38 | 1.62 | −3.3 | 57 |
| b-24 | 1.0 | " | " | " | " | " | " | " | 152 | 53 | 1.61 | −3.4 | 55 |
| b-25 | 3.0 | " | " | " | " | " | " | " | 150 | 53 | 1.63 | −3.4 | 55 |
| b-26 | 0.5 | " | " | " | " | " | " | " | 150 | 51 | 1.56 | −3.7 | 55 |

TABLE 19

| Additives Composition No. | Glass Composition No. | C-Value (V/mm) | n-Value | $V_{100A}/V_{1mA}$ | Change rate after impulse test (%) | Thermal run away life (hr) |
|---|---|---|---|---|---|---|
| a-1 | A1 | 158 | 62 | 1.53 | −3.4 | 75 |
| | A2 | 155 | 63 | 1.53 | −3.3 | 77 |
| | A3 | 159 | 63 | 1.53 | −3.2 | 77 |
| b-1 | A1 | 159 | 62 | 1.56 | −3.6 | 76 |
| | A2 | 155 | 63 | 1.56 | −3.5 | 76 |
| | A3 | 153 | 63 | 1.56 | −3.3 | 76 |

TABLE 20

| Additive Composition No. | Glass Composition No. | C-Value (V/mm) | n-Value | $V_{100A}/V_{1mA}$ | Change rate after impulse test (%) | Thermal run away life (hr) |
|---|---|---|---|---|---|---|
| a-1 | B1 | 151 | 63 | 1.54 | −3.3 | 86 |
| | B2 | 153 | 63 | 1.53 | −3.3 | 87 |
| | B3 | 153 | 64 | 1.53 | −3.2 | 88 |
| b-1 | B1 | 151 | 63 | 1.57 | −3.6 | 86 |
| | B2 | 153 | 63 | 1.56 | −3.6 | 87 |
| | B3 | 153 | 64 | 1.56 | −3.6 | 88 |

TABLE 21

| Additives Composition No. | Glass Composition No. | C-Value (V/mm) | n-Value | $V_{100A}/V_{1mA}$ | Change rate after impulse test (%) | Thermal run away life (hr) |
|---|---|---|---|---|---|---|
| a-1 | E1 | 151 | 73 | 1.53 | −3.3 | 86 |
| | E2 | 152 | 74 | 1.54 | −3.3 | 86 |
| | E3 | 153 | 74 | 1.54 | −3.3 | 86 |
| | E4 | 154 | 73 | 1.54 | −3.4 | 88 |
| b-1 | E1 | 151 | 73 | 1.55 | −3.6 | 85 |
| | E2 | 152 | 74 | 1.56 | −3.6 | 86 |
| | E3 | 153 | 74 | 1.56 | −3.6 | 87 |
| | E4 | 153 | 74 | 1.56 | −3.7 | 88 |

TABLE 22

| No. | Additives (mole %) $Bi_2O_3$ | $Co_2O_3$ | $MnO_2$ | $Sb_2O_3$ | $Cr_2O_3$ | NiO | $Al_2O_3$ | $B_2O_3$ | $Ag_2O$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|---|
| c-1 | 0.5 | 0.5 | 0.5 | 1.0 | 0.5 | 1.0 | 0.0025 | 0.1 | 0 | 153 | 52 | 1.53 | −3.3 | 55 |
| c-2 | " | " | " | " | " | " | " | " | 0.0005 | 152 | 50 | 1.52 | −3.6 | 106 |
| c-3 | " | " | " | " | " | " | " | " | 0.1 | 153 | 52 | 1.53 | −3.3 | 105 |
| c-4 | " | " | " | " | " | " | " | " | 0.3 | 152 | 50 | 1.52 | −3.8 | 109 |
| c-5 | " | " | " | " | " | " | " | 0 | 0.1 | 151 | 50 | 1.54 | −5.4 | 18 |
| c-6 | " | " | " | " | " | " | " | 0.005 | " | 151 | 52 | 1.53 | −3.2 | 108 |
| c-7 | " | " | " | " | " | " | " | 0.3 | " | 153 | 53 | 1.53 | −3.2 | 108 |
| c-8 | " | " | " | " | " | " | 0 | 0.1 | " | 150 | 55 | 1.81 | −6.4 | 17 |
| c-9 | " | " | " | " | " | " | 0.0005 | " | " | 153 | 53 | 1.65 | −2.0 | 105 |
| c-10 | " | " | " | " | " | " | 0.025 | " | " | 157 | 43 | 1.65 | −2.0 | 108 |
| c-11 | " | " | " | " | " | 0 | 0.0025 | " | " | 151 | 57 | 1.59 | −4.6 | 42 |
| c-12 | " | " | " | " | " | 0.1 | " | " | " | 151 | 56 | 1.59 | −3.5 | 101 |
| c-13 | " | " | " | " | " | 3.0 | " | " | " | 167 | 49 | 1.62 | −2.5 | 105 |
| c-14 | " | " | " | " | 0 | 1.0 | " | " | " | 136 | 56 | 1.62 | −6.4 | 42 |
| c-15 | " | " | " | " | 0.05 | " | " | " | " | 140 | 55 | 1.62 | −3.5 | 102 |
| c-16 | " | " | " | " | 1.5 | " | " | " | " | 175 | 51 | 1.61 | −3.4 | 103 |
| c-17 | " | " | " | 0 | 0.5 | " | " | " | " | 127 | 37 | 1.61 | −7.0 | 47 |
| c-18 | " | " | " | 0.1 | " | " | " | " | " | 134 | 51 | 1.58 | −3.2 | 103 |

TABLE 22-continued

| No. | Additives (mole %) $Bi_2O_3$ | $Co_2O_3$ | $MnO_2$ | $Sb_2O_3$ | $Cr_2O_3$ | NiO | $Al_2O_3$ | $B_2O_3$ | $Ag_2O$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|---|
| c-19 | " | " | " | 3.0 | " | " | " | " | " | 195 | 56 | 1.59 | −3.2 | 105 |
| c-20 | " | " | 0 | 1.0 | " | " | " | " | " | 105 | 26 | 1.81 | −7.0 | 45 |
| c-21 | " | " | 0.1 | " | " | " | " | " | " | 125 | 51 | 1.62 | −3.4 | 102 |
| c-22 | " | " | 3.0 | " | " | " | " | " | " | 145 | 53 | 1.61 | −3.2 | 106 |
| c-23 | " | 0 | 0.5 | " | " | " | " | " | " | 104 | 26 | 1.85 | −6.8 | 35 |
| c-24 | " | 0.1 | " | " | " | " | " | " | " | 145 | 51 | 1.62 | −2.8 | 101 |
| c-25 | " | 3.0 | " | " | " | " | " | " | " | 165 | 55 | 1.63 | −3.4 | 107 |
| c-26 | 0 | 0.5 | " | " | " | " | " | " | " | 84 | 6 | 3.53 | −7.3 | 39 |
| c-27 | 0.1 | " | " | " | " | " | " | " | " | 155 | 41 | 1.61 | −3.1 | 105 |
| c-28 | 1.0 | " | " | " | " | " | " | " | " | 153 | 56 | 1.62 | −3.2 | 106 |
| c-29 | 3.0 | " | " | " | " | " | " | " | " | 149 | 55 | 1.63 | −3.2 | 106 |

TABLE 23

| No. | Additives (mole %) $Bi_2O_3$ | $Co_2O_3$ | $MnO_2$ | $Sb_2O_3$ | $Cr_2O_3$ | NiO | $Al_2O_3$ | $B_2O_3$ | $Ag_2O$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|---|
| d-1 | 0.5 | 0.5 | 0.5 | 1.0 | 0.5 | 1.0 | 0.0025 | 0.1 | 0 | 150 | 51 | 1.56 | −3.7 | 55 |
| d-2 | " | " | " | " | " | " | " | " | 0.0005 | 153 | 51 | 1.54 | −3.6 | 105 |
| d-3 | " | " | " | " | " | " | " | " | 0.1 | 155 | 51 | 1.52 | −3.5 | 106 |
| d-4 | " | " | " | " | " | " | " | " | 0.3 | 153 | 51 | 1.52 | −3.8 | 108 |
| d-5 | " | " | " | " | " | " | " | 0 | 0.1 | 152 | 50 | 1.54 | −5.3 | 16 |
| d-6 | " | " | " | " | " | " | " | 0.005 | " | 152 | 52 | 1.53 | −3.2 | 106 |
| d-7 | " | " | " | " | " | " | " | 0.3 | " | 155 | 54 | 1.80 | −3.2 | 106 |
| d-8 | " | " | " | " | " | " | 0 | 0.1 | " | 151 | 56 | 1.64 | −6.3 | 17 |
| d-9 | " | " | " | " | " | " | 0.0005 | " | " | 153 | 53 | 1.64 | −2.1 | 106 |
| d-10 | " | " | " | " | " | " | 0.025 | " | " | 158 | 43 | 1.65 | −2.1 | 108 |
| d-11 | " | " | " | " | " | 0 | 0.0025 | " | " | 152 | 56 | 1.60 | −4.6 | 12 |
| d-12 | " | " | " | " | " | 0.1 | " | " | " | 152 | 55 | 1.59 | −3.6 | 102 |
| d-13 | " | " | " | " | " | 3.0 | " | " | " | 169 | 48 | 1.61 | −2.5 | 106 |
| d-14 | " | " | " | " | 0 | 1.0 | " | " | " | 138 | 55 | 1.62 | −6.3 | 41 |
| d-15 | " | " | " | " | 0.05 | " | " | " | " | 141 | 55 | 1.62 | −3.5 | 103 |
| d-16 | " | " | " | " | 1.5 | " | " | " | " | 172 | 52 | 1.62 | −3.6 | 103 |
| d-17 | " | " | " | 0 | 0.5 | " | " | " | " | 129 | 38 | 1.62 | −6.9 | 45 |
| d-18 | " | " | " | 0.1 | " | " | " | " | " | 136 | 51 | 1.58 | −3.2 | 104 |
| d-19 | " | " | " | 3.0 | " | " | " | " | " | 197 | 55 | 1.58 | −3.1 | 106 |
| d-20 | " | " | 0 | 1.0 | " | " | " | " | " | 106 | 26 | 1.80 | −6.8 | 43 |
| d-21 | " | " | 0.1 | " | " | " | " | " | " | 126 | 50 | 1.62 | −3.3 | 103 |
| d-22 | " | " | 3.0 | " | " | " | " | " | " | 147 | 53 | 1.61 | −3.2 | 107 |
| d-23 | " | 0 | 0.5 | " | " | " | " | " | " | 105 | 27 | 1.82 | −6.8 | 37 |
| d-24 | " | 0.1 | " | " | " | " | " | " | " | 147 | 51 | 1.61 | −2.8 | 101 |
| d-25 | " | 3.0 | " | " | " | " | " | " | " | 167 | 55 | 1.63 | −3.3 | 107 |
| d-26 | 0 | 0.5 | " | " | " | " | " | " | " | 85 | 6 | 3.88 | −7.2 | 38 |
| d-27 | 0.1 | " | " | " | " | " | " | " | " | 155 | 42 | 1.61 | −3.0 | 106 |
| d-28 | 1.0 | " | " | " | " | " | " | " | " | 153 | 57 | 1.61 | −3.0 | 106 |
| d-29 | 3.0 | " | " | " | " | " | " | " | " | 151 | 55 | 1.61 | −3.2 | 106 |

TABLE 24

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | F1 | 158 | 73 | 1.54 | −3.4 | 124 |
| | F2 | 155 | 73 | 1.55 | −3.4 | 122 |
| | F3 | 153 | 73 | 1.55 | −3.4 | 126 |
| b-1 | F1 | 160 | 73 | 1.56 | −3.6 | 123 |
| | F2 | 154 | 73 | 1.57 | −3.6 | 122 |
| | F3 | 153 | 73 | 1.57 | −3.7 | 125 |

TABLE 25

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | G1 | 151 | 74 | 1.53 | −3.4 | 131 |
| | G2 | 151 | 74 | 1.53 | −3.2 | 136 |
| | G3 | 153 | 73 | 1.53 | −3.2 | 132 |
| | G4 | 151 | 73 | 1.53 | −3.3 | 135 |
| b-1 | G1 | 150 | 73 | 1.56 | −3.5 | 132 |
| | G2 | 150 | 73 | 1.56 | −3.5 | 137 |
| | G3 | 153 | 73 | 1.56 | −3.5 | 132 |
| | G4 | 150 | 73 | 1.56 | −3.6 | 135 |

TABLE 26

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | J1 | 150 | 84 | 1.53 | −3.4 | 133 |
| | J2 | 150 | 85 | 1.53 | −3.4 | 135 |
| | J3 | 153 | 85 | 1.53 | −3.3 | 133 |
| | J4 | 151 | 84 | 1.54 | −3.3 | 136 |
| b-1 | J1 | 151 | 83 | 1.56 | −3.7 | 133 |
| | J2 | 151 | 83 | 1.56 | −3.7 | 135 |
| | J3 | 153 | 84 | 1.56 | −3.7 | 132 |
| | J4 | 151 | 85 | 1.57 | −3.6 | 135 |

TABLE 27

| | Additives (mole %) | | | | | | | | | C-Value | n-Value | | Change rate after Impulse test | Thermal run away life |
|---|---|---|---|---|---|---|---|---|---|---|---|---|---|---|
| No. | $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | (V/mm) | | $V_{100A}/V_{1mA}$ | (%) | (hr) |
| a-1 | 0.5 | 0.5 | 0.5 | 1.0 | 0.5 | 1.0 | 0.5 | 0.0025 | 0 | 211 | 51 | 1.45 | −5.1 | 9 |
| a-2 | ↑ | ↑ | ↑ | ↑ | ↑ | ↑ | ↑ | ↑ | 0.005 | 211 | 52 | 1.43 | −2.9 | 151 |
| a-3 | ↑ | ↑ | ↑ | ↑ | ↑ | ↑ | ↑ | ↑ | 0.3 | 211 | 53 | 1.45 | −2.7 | 159 |
| a-4 | ↑ | ↑ | ↑ | ↑ | ↑ | ↑ | ↑ | 0 | 0.1 | 210 | 55 | 1.75 | −6.7 | 8 |
| a-5 | ↑ | ↑ | ↑ | ↑ | ↑ | ↑ | ↑ | 0.0005 | ↓ | 210 | 53 | 1.45 | −1.9 | 153 |
| a-6 | ↑ | ↑ | ↑ | ↑ | ↑ | ↑ | ↑ | 0.025 | ↓ | 222 | 43 | 1.53 | −1.9 | 155 |
| a-7 | ↑ | ↑ | ↑ | ↑ | ↑ | ↑ | 0 | 0.0025 | ↓ | 151 | 50 | 1.55 | −3.8 | 57 |
| a-8 | ↑ | ↑ | ↑ | ↑ | ↑ | ↑ | 0.1 | ↓ | ↓ | 176 | 58 | 1.48 | −2.8 | 151 |
| a-9 | ↑ | ↑ | ↑ | ↑ | ↑ | ↑ | 10.0 | ↓ | ↓ | 435 | 59 | 1.45 | −1.5 | 154 |
| a-10 | ↑ | ↑ | ↑ | ↑ | ↑ | 0 | 0.5 | ↓ | ↓ | 210 | 53 | 1.50 | −4.5 | 57 |
| a-11 | ↑ | ↑ | ↑ | ↑ | ↑ | 0.1 | ↓ | ↓ | ↓ | 211 | 52 | 1.52 | −2.5 | 156 |
| a-12 | ↑ | ↑ | ↑ | ↑ | ↑ | 3.0 | ↓ | ↓ | ↓ | 233 | 45 | 1.55 | −1.5 | 157 |
| a-13 | ↑ | ↑ | ↑ | ↑ | 0 | 1.0 | ↓ | ↓ | ↓ | 187 | 53 | 1.53 | −6.0 | 63 |
| a-14 | ↑ | ↑ | ↑ | ↑ | 0.05 | ↓ | ↓ | ↓ | ↓ | 191 | 53 | 1.51 | −2.7 | 151 |
| a-15 | ↑ | ↑ | ↑ | ↑ | 1.5 | ↓ | ↓ | ↓ | ↓ | 235 | 45 | 1.55 | −2.7 | 156 |
| a-16 | ↑ | ↑ | ↑ | 0 | 0.5 | ↓ | ↓ | ↓ | ↓ | 176 | 43 | 1.53 | −6.8 | 55 |
| a-17 | ↑ | ↑ | ↑ | 0.1 | ↓ | ↓ | ↓ | ↓ | ↓ | 185 | 52 | 1.48 | −2.5 | 152 |
| a-18 | ↑ | ↑ | ↑ | 3.0 | ↓ | ↓ | ↓ | ↓ | ↓ | 245 | 55 | 1.49 | −2.3 | 150 |
| a-19 | ↑ | ↑ | 0 | 1.0 | ↓ | ↓ | ↓ | ↓ | ↓ | 148 | 28 | 1.75 | −6.5 | 55 |
| a-20 | ↑ | ↑ | 0.1 | ↓ | ↓ | ↓ | ↓ | ↓ | ↓ | 201 | 51 | 1.51 | −2.5 | 153 |
| a-21 | ↑ | ↑ | 3.0 | ↓ | ↓ | ↓ | ↓ | ↓ | ↓ | 210 | 53 | 1.52 | −2.5 | 152 |
| a-22 | ↑ | 0 | 0.5 | ↓ | ↓ | ↓ | ↓ | ↓ | ↓ | 133 | 28 | 1.75 | −6.5 | 56 |
| a-23 | ↑ | 0.1 | ↓ | ↓ | ↓ | ↓ | ↓ | ↓ | ↓ | 178 | 40 | 1.55 | −2.3 | 151 |
| a-24 | ↑ | 3.0 | ↓ | ↓ | ↓ | ↓ | ↓ | ↓ | ↓ | 217 | 55 | 1.55 | −2.8 | 155 |
| a-25 | 0 | 0.5 | ↓ | ↓ | ↓ | ↓ | ↓ | ↓ | ↓ | 95 | 6 | 3.51 | −6.7 | 65 |
| a-26 | 0.1 | ↓ | ↓ | ↓ | ↓ | ↓ | ↓ | ↓ | ↓ | 177 | 41 | 1.50 | −2.3 | 153 |
| a-27 | 1.0 | ↓ | ↓ | ↓ | ↓ | ↓ | ↓ | ↓ | ↓ | 205 | 59 | 1.51 | −2.5 | 155 |
| a-28 | 3.0 | ↓ | ↓ | ↓ | ↓ | ↓ | ↓ | ↓ | ↓ | 203 | 58 | 1.52 | −2.7 | 155 |
| a-29 | 0.5 | ↓ | ↓ | ↓ | ↓ | ↓ | ↓ | ↓ | ↓ | 211 | 52 | 1.44 | −1.7 | 158 |

The symbol ↕ indicates same amounts

TABLE 28

| | Additives (mole %) | | | | | | | | | C-Value | n-Value | | Change rate after Impulse test | Thermal run away life |
|---|---|---|---|---|---|---|---|---|---|---|---|---|---|---|
| No. | $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | (V/mm) | | $V_{100A}/V_{1mA}$ | (%) | (hr) |
| b-1 | 0.5 | 0.5 | 0.5 | 1.0 | 0.5 | 1.0 | 0.5 | 0.0025 | 0 | 212 | 51 | 1.45 | −5.2 | 9 |
| b-2 | ↑ | ↑ | ↑ | ↑ | ↑ | ↑ | ↑ | ↑ | 0.005 | 212 | 51 | 1.45 | −2.8 | 152 |
| b-3 | ↑ | ↑ | ↑ | ↑ | ↑ | ↑ | ↑ | ↑ | 0.3 | 212 | 52 | 1.45 | −2.8 | 158 |
| b-4 | ↑ | ↑ | ↑ | ↑ | ↑ | ↑ | ↑ | 0 | 0.1 | 209 | 55 | 1.73 | −6.9 | 8 |
| b-5 | ↑ | ↑ | ↑ | ↑ | ↑ | ↑ | ↑ | 0.0005 | ↓ | 209 | 53 | 1.43 | −1.9 | 153 |
| b-6 | ↑ | ↑ | ↑ | ↑ | ↑ | ↑ | ↑ | 0.025 | ↓ | 219 | 43 | 1.52 | −1.8 | 153 |
| b-7 | ↑ | ↑ | ↑ | ↑ | ↑ | ↑ | 0 | 0.0025 | ↓ | 150 | 51 | 1.56 | −3.7 | 55 |
| b-8 | ↑ | ↑ | ↑ | ↑ | ↑ | ↑ | 0.1 | ↓ | ↓ | 178 | 59 | 1.49 | −2.8 | 152 |
| b-9 | ↑ | ↑ | ↑ | ↑ | ↑ | ↑ | 10.0 | ↓ | ↓ | 426 | 59 | 1.46 | −1.7 | 153 |
| b-10 | ↑ | ↑ | ↑ | ↑ | ↑ | 0 | 0.5 | ↓ | ↓ | 212 | 54 | 1.50 | −4.7 | 55 |
| b-11 | ↑ | ↑ | ↑ | ↑ | ↑ | 0.1 | ↓ | ↓ | ↓ | 213 | 52 | 1.50 | −2.3 | 156 |
| b-12 | ↑ | ↑ | ↑ | ↑ | ↑ | 3.0 | ↓ | ↓ | ↓ | 233 | 41 | 1.54 | −1.8 | 157 |
| b-13 | ↑ | ↑ | ↑ | ↑ | 0 | 1.0 | ↓ | ↓ | ↓ | 175 | 50 | 1.54 | −6.1 | 63 |
| b-14 | ↑ | ↑ | ↑ | ↑ | 0.05 | ↓ | ↓ | ↓ | ↓ | 186 | 51 | 1.51 | −2.8 | 150 |
| b-15 | ↑ | ↑ | ↑ | ↑ | 1.5 | ↓ | ↓ | ↓ | ↓ | 249 | 43 | 1.56 | −2.8 | 155 |
| b-16 | ↑ | ↑ | ↑ | 0 | 0.5 | ↓ | ↓ | ↓ | ↓ | 173 | 43 | 1.53 | −6.9 | 54 |
| b-17 | ↑ | ↑ | ↑ | 0.1 | ↓ | ↓ | ↓ | ↓ | ↓ | 183 | 50 | 1.49 | −2.5 | 151 |
| b-18 | ↑ | ↑ | ↑ | 3.0 | ↓ | ↓ | ↓ | ↓ | ↓ | 255 | 50 | 1.49 | −2.1 | 155 |
| b-19 | ↑ | ↑ | 0 | 1.0 | ↓ | ↓ | ↓ | ↓ | ↓ | 1.49 | 27 | 1.75 | −6.6 | 54 |
| b-20 | ↑ | ↑ | 0.1 | ↓ | ↓ | ↓ | ↓ | ↓ | ↓ | 203 | 51 | 1.51 | −2.5 | 152 |

TABLE 28-continued

| No. | Additives (mole %) $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|---|
| b-21 | ↑ | ↑ | 3.0 | ↓ | ↓ | ↓ | ↓ | ↓ | ↓ | 213 | 53 | 1.51 | −2.3 | 152 |
| b-22 | ↑ | 0 | 0.5 | ↓ | ↓ | ↓ | ↓ | ↓ | ↓ | 132 | 28 | 1.77 | −6.2 | 56 |
| b-23 | ↑ | 0.1 | ↓ | ↓ | ↓ | ↓ | ↓ | ↓ | ↓ | 178 | 41 | 1.55 | −2.3 | 152 |
| b-24 | ↑ | 3.0 | ↓ | ↓ | ↓ | ↓ | ↓ | ↓ | ↓ | 221 | 51 | 1.54 | −2.8 | 153 |
| b-25 | 0 | 0.5 | ↓ | ↓ | ↓ | ↓ | ↓ | ↓ | ↓ | 90 | 6 | 3.31 | −6.5 | 67 |
| b-26 | 0.1 | ↓ | ↓ | ↓ | ↓ | ↓ | ↓ | ↓ | ↓ | 170 | 40 | 1.51 | −2.1 | 152 |
| b-27 | 1.0 | ↓ | ↓ | ↓ | ↓ | ↓ | ↓ | ↓ | ↓ | 207 | 58 | 1.51 | −2.3 | 152 |
| b-28 | 3.0 | ↓ | ↓ | ↓ | ↓ | ↓ | ↓ | ↓ | ↓ | 203 | 58 | 1.51 | −2.5 | 152 |
| b-29 | 0.5 | ↓ | ↓ | ↓ | ↓ | ↓ | ↓ | ↓ | ↓ | 210 | 51 | 1.45 | −1.8 | 157 |

The symbol ↕ indicates same amounts

TABLE 29

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | A1 | 232 | 63 | 1.45 | −1.9 | 168 |
| | A2 | 225 | 63 | 1.45 | −1.9 | 168 |
| | A3 | 221 | 62 | 1.44 | −1.8 | 169 |
| b-1 | A1 | 231 | 62 | 1.44 | −1.8 | 168 |
| | A2 | 225 | 63 | 1.44 | −1.9 | 168 |
| | A3 | 219 | 63 | 1.44 | −1.8 | 168 |

TABLE 30

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | B1 | 210 | 64 | 1.45 | −1.8 | 179 |
| | B2 | 213 | 63 | 1.45 | −1.8 | 178 |
| | B3 | 213 | 65 | 1.44 | −1.8 | 178 |
| b-1 | B1 | 210 | 63 | 1.44 | −1.7 | 178 |

TABLE 30-continued

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| | B2 | 211 | 63 | 1.44 | −1.8 | 178 |
| | B3 | 211 | 63 | 1.44 | −1.8 | 178 |

TABLE 31

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | E1 | 211 | 75 | 1.45 | −1.8 | 178 |
| | E2 | 211 | 73 | 1.45 | −1.8 | 177 |
| | E3 | 211 | 75 | 1.45 | −1.7 | 177 |
| | E4 | 213 | 75 | 1.45 | −1.7 | 177 |
| b-1 | E1 | 210 | 74 | 1.45 | −1.7 | 178 |
| | E2 | 211 | 74 | 1.45 | −1.8 | 177 |
| | E3 | 211 | 73 | 1.45 | −1.7 | 177 |
| | E4 | 212 | 75 | 1.44 | −1.9 | 177 |

TABLE 32

| No. | Additives (mole %) $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | $Ag_2O$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|---|---|
| c-1 | 0.5 | 0.5 | 0.5 | 1.0 | 0.5 | 1.0 | 0.5 | 0.0035 | 0.1 | 0 | 211 | 51 | 1.45 | −1.8 | 155 |
| c-2 | ↑ | ↑ | ↑ | ↑ | ↑ | ↑ | ↑ | ↑ | ↑ | 0.0005 | 210 | 58 | 1.44 | −1.6 | 191 |
| c-3 | ↑ | ↑ | ↑ | ↑ | ↑ | ↑ | ↑ | ↑ | ↑ | 0.1 | 210 | 59 | 1.44 | −1.5 | 198 |
| c-4 | ↑ | ↑ | ↑ | ↑ | ↑ | ↑ | ↑ | ↑ | ↑ | 0.3 | 211 | 59 | 1.44 | −1.6 | 198 |
| c-5 | ↑ | ↑ | ↑ | ↑ | ↑ | ↑ | ↑ | ↑ | 0 | 0.1 | 211 | 58 | 1.45 | −2.5 | 18 |
| c-6 | ↑ | ↑ | ↑ | ↑ | ↑ | ↑ | ↑ | ↑ | 0.005 | ↓ | 210 | 55 | 1.43 | −2.8 | 192 |
| c-7 | ↑ | ↑ | ↑ | ↑ | ↑ | ↑ | ↑ | ↑ | 0.3 | ↓ | 210 | 55 | 1.44 | −2.7 | 197 |
| c-8 | ↑ | ↑ | ↑ | ↑ | ↑ | ↑ | ↑ | 0 | 0.1 | ↓ | 211 | 55 | 1.76 | −6.5 | 17 |
| c-9 | ↑ | ↑ | ↑ | ↑ | ↑ | ↑ | ↑ | 0.0005 | ↓ | ↓ | 211 | 58 | 1.46 | −1.8 | 191 |
| c-10 | ↑ | ↑ | ↑ | ↑ | ↑ | ↑ | ↑ | 0.025 | ↓ | ↓ | 220 | 50 | 1.53 | −1.9 | 195 |
| c-11 | ↑ | ↑ | ↑ | ↑ | ↑ | ↑ | 0 | 0.0035 | ↓ | ↓ | 153 | 52 | 1.53 | −3.3 | 105 |
| c-12 | ↑ | ↑ | ↑ | ↑ | ↑ | ↑ | 0.1 | ↓ | ↓ | ↓ | 177 | 59 | 1.48 | −2.9 | 192 |
| c-13 | ↑ | ↑ | ↑ | ↑ | ↑ | ↑ | 10.0 | ↓ | ↓ | ↓ | 433 | 59 | 1.16 | −1.5 | 193 |
| c-14 | ↑ | ↑ | ↑ | ↑ | ↑ | 0 | 0.5 | ↓ | ↓ | ↓ | 211 | 55 | 1.51 | −4.7 | 106 |
| c-15 | ↑ | ↑ | ↑ | ↑ | ↑ | 0.1 | ↓ | ↓ | ↓ | ↓ | 211 | 55 | 1.51 | −2.6 | 193 |
| c-16 | ↑ | ↑ | ↑ | ↑ | ↑ | 3.0 | ↓ | ↓ | ↓ | ↓ | 235 | 51 | 1.56 | −1.5 | 195 |
| c-17 | ↑ | ↑ | ↑ | ↑ | 0 | 1.0 | ↓ | ↓ | ↓ | ↓ | 188 | 55 | 1.54 | −6.3 | 72 |
| c-18 | ↑ | ↑ | ↑ | ↑ | 0.05 | ↓ | ↓ | ↓ | ↓ | ↓ | 192 | 55 | 1.51 | −2.7 | 192 |
| c-19 | ↑ | ↑ | ↑ | ↑ | 1.5 | ↓ | ↓ | ↓ | ↓ | ↓ | 236 | 53 | 1.55 | −2.6 | 193 |
| c-20 | ↑ | ↑ | ↑ | 0 | 0.5 | ↓ | ↓ | ↓ | ↓ | ↓ | 177 | 51 | 1.53 | −6.9 | 64 |
| c-21 | ↑ | ↑ | ↑ | 0.1 | ↓ | ↓ | ↓ | ↓ | ↓ | ↓ | 185 | 53 | 1.49 | −2.1 | 193 |
| c-22 | ↑ | ↑ | ↑ | 3.0 | ↓ | ↓ | ↓ | ↓ | ↓ | ↓ | 286 | 57 | 1.48 | −2.1 | 197 |
| c-23 | ↑ | ↑ | 0 | 1.0 | ↓ | ↓ | ↓ | ↓ | ↓ | ↓ | 149 | 29 | 1.77 | −6.3 | 65 |
| c-24 | ↑ | ↑ | 0.1 | ↓ | ↓ | ↓ | ↓ | ↓ | ↓ | ↓ | 200 | 52 | 1.52 | −2.4 | 193 |

TABLE 32-continued

| No. | Additives (mole %) $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | $Ag_2O$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|---|---|
| c-25 | ↑ | ↑ | 3.0 | ↓ | ↓ | ↓ | ↓ | ↓ | ↓ | ↓ | 211 | 34 | 1.52 | −2.4 | 197 |
| c-26 | ↑ | 0 | 0.5 | ↓ | ↓ | ↓ | ↓ | ↓ | ↓ | ↓ | 135 | 29 | 1.76 | −6.3 | 66 |
| c-27 | ↑ | 0.1 | ↓ | ↓ | ↓ | ↓ | ↓ | ↓ | ↓ | ↓ | 179 | 52 | 1.56 | −2.1 | 195 |
| c-28 | ↑ | 3.0 | ↓ | ↓ | ↓ | ↓ | ↓ | ↓ | ↓ | ↓ | 218 | 56 | 1.55 | −2.8 | 198 |
| c-29 | 0 | 0.5 | ↓ | ↓ | ↓ | ↓ | ↓ | ↓ | ↓ | ↓ | 86 | 6 | 3.43 | −6.5 | 75 |
| c-30 | 0.1 | ↓ | ↓ | ↓ | ↓ | ↓ | ↓ | ↓ | ↓ | ↓ | 178 | 53 | 1.51 | −2.1 | 192 |
| c-31 | 1.0 | ↓ | ↓ | ↓ | ↓ | ↓ | ↓ | ↓ | ↓ | ↓ | 206 | 59 | 1.53 | −2.1 | 196 |
| c-32 | 3.0 | ↓ | ↓ | ↓ | ↓ | ↓ | ↓ | ↓ | ↓ | ↓ | 205 | 59 | 1.53 | −2.5 | 198 |

The symbol ↕ indicates same amounts

TABLE 33

| No. | Additives (mole %) $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | $Ag_2O$ | C-Value (V/mm) | n-Value | $V_{100A}/V_{1mA}$ | Change rate after Impulse test (%) | Thermal run away life (hr) |
|---|---|---|---|---|---|---|---|---|---|---|---|---|---|---|---|
| d-1 | 0.5 | 0.5 | 0.5 | 1.0 | 0.5 | 1.0 | 0.5 | 0.0025 | 0.1 | 0 | 211 | 52 | 1.44 | −1.9 | 153 |
| d-2 | ↑ | ↑ | ↑ | ↑ | ↑ | ↑ | ↑ | ↑ | ↑ | 0.0005 | 209 | 57 | 1.44 | −1.6 | 192 |
| d-3 | ↑ | ↑ | ↑ | ↑ | ↑ | ↑ | ↑ | ↑ | ↑ | 0.1 | 209 | 59 | 1.44 | −1.5 | 179 |
| d-4 | ↑ | ↑ | ↑ | ↑ | ↑ | ↑ | ↑ | ↑ | ↑ | 0.3 | 211 | 59 | 1.44 | −1.7 | 196 |
| d-5 | ↑ | ↑ | ↑ | ↑ | ↑ | ↑ | ↑ | ↑ | 0 | 0.1 | 211 | 58 | 1.45 | −2.3 | 18 |
| d-6 | ↑ | ↑ | ↑ | ↑ | ↑ | ↑ | ↑ | ↑ | 0.005 | ↓ | 210 | 55 | 1.43 | −2.6 | 192 |
| d-7 | ↑ | ↑ | ↑ | ↑ | ↑ | ↑ | ↑ | ↑ | 0.3 | ↓ | 211 | 54 | 1.44 | −2.6 | 195 |
| d-8 | ↑ | ↑ | ↑ | ↑ | ↑ | ↑ | ↑ | 0 | 0.1 | ↓ | 211 | 54 | 1.75 | −6.7 | 17 |
| d-9 | ↑ | ↑ | ↑ | ↑ | ↑ | ↑ | ↑ | 0.0005 | ↓ | ↓ | 211 | 55 | 1.46 | −2.0 | 192 |
| d-10 | ↑ | ↑ | ↑ | ↑ | ↑ | ↑ | ↑ | 0.025 | ↓ | ↓ | 223 | 51 | 1.52 | −2.0 | 195 |
| d-11 | ↑ | ↑ | ↑ | ↑ | ↑ | ↑ | 0 | 0.0025 | ↓ | ↓ | 155 | 51 | 1.52 | −3.5 | 106 |
| d-12 | ↑ | ↑ | ↑ | ↑ | ↑ | ↑ | 0.1 | ↓ | ↓ | ↓ | 177 | 58 | 1.48 | −2.8 | 192 |
| d-13 | ↑ | ↑ | ↑ | ↑ | ↑ | ↑ | 10.0 | ↓ | ↓ | ↓ | 438 | 58 | 1.45 | −1.8 | 194 |
| d-14 | ↑ | ↑ | ↑ | ↑ | ↑ | 0 | 0.5 | ↓ | ↓ | ↓ | 210 | 54 | 1.50 | −4.5 | 107 |
| d-15 | ↑ | ↑ | ↑ | ↑ | ↑ | 0.1 | ↓ | ↓ | ↓ | ↓ | 210 | 55 | 1.50 | −2.7 | 193 |
| d-16 | ↑ | ↑ | ↑ | ↑ | ↑ | 3.0 | ↓ | ↓ | ↓ | ↓ | 237 | 51 | 1.56 | −1.6 | 196 |
| d-17 | ↑ | ↑ | ↑ | ↑ | 0 | 1.0 | ↓ | ↓ | ↓ | ↓ | 186 | 53 | 1.54 | −6.4 | 73 |
| d-18 | ↑ | ↑ | ↑ | ↑ | 0.05 | ↓ | ↓ | ↓ | ↓ | ↓ | 190 | 54 | 1.51 | −2.7 | 193 |
| d-19 | ↑ | ↑ | ↑ | ↑ | 1.5 | ↓ | ↓ | ↓ | ↓ | ↓ | 230 | 54 | 1.55 | −2.7 | 194 |
| d-20 | ↑ | ↑ | ↑ | 0 | 0.5 | ↓ | ↓ | ↓ | ↓ | ↓ | 176 | 52 | 1.53 | −7.0 | 65 |
| d-21 | ↑ | ↑ | ↑ | 0.1 | ↓ | ↓ | ↓ | ↓ | ↓ | ↓ | 184 | 52 | 1.49 | −2.0 | 197 |
| d-22 | ↑ | ↑ | ↑ | 3.0 | ↓ | ↓ | ↓ | ↓ | ↓ | ↓ | 243 | 57 | 1.48 | −2.0 | 197 |
| d-23 | ↑ | ↑ | 0 | 1.0 | ↓ | ↓ | ↓ | ↓ | ↓ | ↓ | 145 | 26 | 1.76 | −6.2 | 65 |
| d-24 | ↑ | ↑ | 0.1 | ↓ | ↓ | ↓ | ↓ | ↓ | ↓ | ↓ | 201 | 52 | 1.51 | −2.4 | 193 |
| d-25 | ↑ | ↑ | 3.0 | ↓ | ↓ | ↓ | ↓ | ↓ | ↓ | ↓ | 212 | 53 | 1.51 | −2.4 | 197 |
| d-26 | ↑ | 0 | 0.5 | ↓ | ↓ | ↓ | ↓ | ↓ | ↓ | ↓ | 136 | 28 | 1.77 | −6.1 | 67 |
| d-27 | ↑ | 0.1 | ↓ | ↓ | ↓ | ↓ | ↓ | ↓ | ↓ | ↓ | 183 | 50 | 1.56 | −2.0 | 195 |
| d-28 | ↑ | 3.0 | ↓ | ↓ | ↓ | ↓ | ↓ | ↓ | ↓ | ↓ | 219 | 57 | 1.55 | −2.6 | 198 |
| d-29 | 0 | 0.5 | ↓ | ↓ | ↓ | ↓ | ↓ | ↓ | ↓ | ↓ | 95 | 6 | 3.51 | −6.0 | 75 |
| d-30 | 0.1 | ↓ | ↓ | ↓ | ↓ | ↓ | ↓ | ↓ | ↓ | ↓ | 179 | 51 | 1.50 | −2.2 | 192 |
| d-31 | 1.0 | ↓ | ↓ | ↓ | ↓ | ↓ | ↓ | ↓ | ↓ | ↓ | 206 | 59 | 1.50 | −2.2 | 195 |
| d-32 | 3.0 | ↓ | ↓ | ↓ | ↓ | ↓ | ↓ | ↓ | ↓ | ↓ | 206 | 58 | 1.50 | −2.5 | 197 |

The symbol ↕ indicates same amounts

TABLE 34

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | F1 | 230 | 73 | 1.44 | −1.8 | 217 |
| | F2 | 224 | 72 | 1.44 | −1.9 | 218 |
| | F3 | 218 | 72 | 1.44 | −1.9 | 217 |
| b-1 | F1 | 230 | 72 | 1.44 | −1.8 | 217 |
| | F2 | 223 | 71 | 1.44 | −1.8 | 217 |
| | F3 | 217 | 71 | 1.44 | −1.8 | 217 |

TABLE 35

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | G1 | 210 | 73 | 1.44 | −1.8 | 228 |
| | G2 | 211 | 73 | 1.44 | −1.8 | 227 |
| | G3 | 211 | 73 | 1.44 | −1.8 | 228 |
| | G4 | 211 | 72 | 1.44 | −1.9 | 228 |
| b-1 | G1 | 210 | 73 | 1.44 | −1.8 | 228 |
| | G2 | 211 | 73 | 1.44 | −1.8 | 227 |
| | G3 | 211 | 73 | 1.44 | −1.8 | 227 |
| | G4 | 211 | 72 | 1.44 | −1.9 | 227 |

TABLE 36

| Additives composition no. | Glass composition No. | C-Value (V/mm) | n-Value | $V_{100A}/V_{1mA}$ | Change rate after impulse test (%) | Thermal run away life (hr) |
|---|---|---|---|---|---|---|
| a-1 | J1 | 210 | 84 | 1.44 | −1.5 | 228 |
| | J2 | 211 | 85 | 1.44 | −1.4 | 228 |
| | J3 | 213 | 85 | 1.44 | −1.4 | 229 |
| | J4 | 211 | 84 | 1.44 | −1.5 | 229 |
| b-1 | J1 | 210 | 83 | 1.44 | −1.5 | 229 |
| | J2 | 211 | 83 | 1.44 | −1.4 | 229 |
| | J3 | 213 | 83 | 1.44 | −1.5 | 228 |
| | J4 | 211 | 83 | 1.44 | −1.5 | 228 |

What is claimed is:

1. A voltage-dependent resistor of bulk-type comprising a sintered body consisting essentially of, as a main constituent, zinc oxide (ZnO) and, as additives, 0.1 to 3.0 mole percent of bismuth oxide ($Bi_2O_3$), 0.1 to 3.0 mole percent of cobalt oxide ($Co_2O_3$), 0.1 to 3.0 mole percent of manganese oxide ($MnO_2$), 0.1 to 3.0 mole percent of antimony oxide ($Sb_2O_3$), 0.05 to 1.5 mole percent of chromium oxide ($Cr_2O_3$), 0.005 to 0.3 mole percent of boron oxide ($B_2O_3$), at least one member selected from the group of 0.0005 to 0.025 mole percent of aluminum oxide ($Al_2O_3$) and 0.0005 to 0.025 mole percent of gallium oxide ($Ga_2O_3$), and at least one member selected from the group of 0.1 to 3.0 mole percent of nickel oxide (NiO) and 0.1 to 10.0 mole percent of silicon oxide ($SiO_2$) with electrodes applied to opposite surfaces of said sintered body.

2. A voltage-dependent resistor of bulk-type comprising a sintered body consisting essentially of, as a main constituent, zinc oxide (ZnO) and, as additives, 0.1 to 3.0 mole percent of bismuth oxide ($Bi_2O_3$), 0.1 to 3.0 mole percent of cobalt oxide ($Co_2O_3$), 0.1 to 3.0 mole percent of manganese oxide ($MnO_2$), 0.1 to 3.0 mole percent of antimony oxide ($Sb_2O_3$), 0.05 to 1.5 mole percent of chromium oxide ($Cr_2O_3$), 0.0005 to 0.3 mole percent of boron oxide ($B_2O_3$), at least one member selected from the group of 0.0005 to 0.025 mole percent of aluminum oxide ($Al_2O_3$) and 0.0005 to 0.025 mole percent of gallium oxide ($Ga_2O_3$), and at least one member selected from the group of 0.1 to 3.0 mole percent of nickel oxide (NiO) and 0.1 to 10.0 mole percent of silicon oxide ($SiO_2$) and 0.0005 to 0.3 mole percent of silver oxide ($Ag_2O$), with electrodes applied to opposite surfaces of said sintered body.

* * * * *